US011713521B2

(12) United States Patent
Tardy et al.

(10) Patent No.: US 11,713,521 B2
(45) Date of Patent: Aug. 1, 2023

(54) PULLING MECHANISM FOR CONTROLLING THE HEALD FRAMES OF A LOOM AND LOOM COMPRISING SUCH A MECHANISM

(71) Applicant: STAUBLI FAVERGES, Faverges-Seythenex (FR)

(72) Inventors: Bastien Tardy, Argonay (FR); Francois Pollet, Annecy le Vieux (FR)

(73) Assignee: STAUBLI FAVERGES, Faverges-Seythenex (FR)

( * ) Notice: Subject to any disclaimer, the term of this patent is extended or adjusted under 35 U.S.C. 154(b) by 0 days.

(21) Appl. No.: 17/699,310

(22) Filed: Mar. 21, 2022

(65) Prior Publication Data

US 2022/0307163 A1 Sep. 29, 2022

(51) Int. Cl.

| | |
|---|---|
| ***D03C 1/14*** | (2006.01) |
| ***D03C 1/00*** | (2006.01) |
| ***D03C 1/16*** | (2006.01) |
| ***D03C 9/06*** | (2006.01) |
| *D03D 51/02* | (2006.01) |

(52) U.S. Cl.

CPC ..... *D03C 1/146* (2013.01); *D03C 1/005* (2013.01); *D03C 1/16* (2013.01); *D03C 9/06* (2013.01); *D03C 2700/01* (2013.01)

(58) Field of Classification Search

CPC ..... D03C 1/146; D03C 1/005; D03C 1/16; D03C 9/06; D03C 2700/01; D03C 1/144; D03C 5/00

See application file for complete search history.

(56) References Cited

U.S. PATENT DOCUMENTS 3,593,752 A * 7/1971 Moessinger ..... D03D 41/00 139/18
3,612,108 A * 10/1971 Schwarz ..... D03C 1/10 139/50
3,759,298 A * 9/1973 Kaufmann ..... D03C 1/10 139/55.1

(Continued)

FOREIGN PATENT DOCUMENTS

EP 0542350 A1 5/1993
EP 3341509 7/2018

(Continued)

OTHER PUBLICATIONS

French Search Report dated Nov. 19, 2021, for French Application No. 2102966 filed Mar. 24, 2021.

*Primary Examiner* — Robert H Muromoto, Jr.

(57) ABSTRACT

A pulling mechanism for controlling the heald frames of a loom equipped with a shedding machine includes a set of connecting rods and oscillating levers (72) coupled to the set of connecting rods, for each heald frame, for returning a movement of the shedding machine to the heald frame. The pulling mechanism includes at least one measuring portion (72C), equipped with a target (100) configured to interact with a sensor (110). For easier mounting and dismounting of the targets on the measuring portions, each measuring portion is provided on a peripheral wall of one of the oscillating levers (72), or a stabilizer of the pulling mechanism, the target being reversibly mounted on the measuring portion (72C).

20 Claims, 12 Drawing Sheets

(56) References Cited

U.S. PATENT DOCUMENTS 3,907,005 A * 9/1975 Demuth ..... D03D 51/18 139/340
3,958,608 A * 5/1976 Rohr ..... D03C 5/02 139/66 R
4,379,474 A * 4/1983 Mueller ..... D03C 9/0683 139/55.1
4,412,563 A * 11/1983 Kleiner ..... D03C 1/10 139/66 R
4,614,211 A * 9/1986 Mettler ..... D03C 1/00 139/66 R
4,685,492 A * 8/1987 Takada ..... D03C 1/144 139/331
5,365,979 A * 11/1994 Yoshida ..... D03C 1/144 139/68
5,647,402 A * 7/1997 Palau ..... D03C 1/144 184/26
5,810,055 A * 9/1998 Haeussler ..... D03C 9/0683 139/57
5,944,061 A * 8/1999 Eriksson ..... D03C 1/144 139/66 R
6,145,548 A * 11/2000 Fumex ..... D03C 1/16 74/105
6,948,529 B2 * 9/2005 Fumex ..... D03C 1/144 139/57
9,873,961 B2 * 1/2018 Cittadini ..... D03C 5/005
10,494,745 B2 * 12/2019 Sampers ..... D03C 9/0683
10,501,872 B2 * 12/2019 Sampers ..... D03C 13/025
2014/0238526 A1 * 8/2014 Tardy ..... D03C 9/0683 139/55.1
2017/0121865 A1 * 5/2017 Cittadini ..... D03C 5/005
2018/0237962 A1 * 8/2018 Sampers ..... D03C 9/0683
2018/0291537 A1 * 10/2018 Sampers ..... D03C 9/0683
2022/0307163 A1 * 9/2022 Tardy ..... D03C 1/146
2023/0075656 A1 * 3/2023 Grange ..... D03C 1/146

FOREIGN PATENT DOCUMENTS

FR 2977592 A1 1/2013
WO 200600559 A2 1/2006
WO 2006005599 A3 1/2006
WO 2017032557 A1 3/2017

* cited by examiner

PULLING MECHANISM FOR CONTROLLING THE HEALD FRAMES OF A LOOM AND LOOM COMPRISING SUCH A MECHANISM

The present invention relates to a pulling mechanism for controlling the heald frames of a loom equipped with a shedding machine, as well as a loom equipped with a shedding machine and comprising such a pulling mechanism.

In the field of looms, mechanical dobby, electronic dobby or mechanical cam-type shedding machines are known. Regardless of the type, the shedding machine comprises a drive system with output rods, which drive sets of levers and rods forming the frame pulling mechanism in parallel. For the mechanical dobby type and the mechanical cam type, each output rod is articulated to an exit arm. For the electronic dobby type, each output rod is articulated to a crank connected to an independent electric actuator with an oscillating rotary movement. In other words, and in a known way, a crank is articulated between the electric actuator, such as a motor, and an output rod. The frames, also known as heald frames, are traversed by the warp yarn sheets and are driven by the shedding machine in a weave intended for weaving cycles of the warp yarn sheets with weft yarn insertions.

Each set of levers and rods corresponding to a frame moves in relation to the neighboring sets, the set being commonly referred to as the "draft", the levers and rods constituting the draft mechanism. Depending on the shed setting applied between the draft mechanism and the shedding machine, the vertical stroke of the heald frames can vary as desired by the technician so that the amplitude, speed, acceleration or position at the crossing are variable proportionally, and may be poorly known, while the final and precise kinematics of the frames is the optimum sought to guarantee a fabric quality, and follow a desired productivity.

Due to the parallel frame configuration that evolves in a reduced space, often at high speed, the measurement environment design, the measurement methods known elsewhere and possible accesses to the technician quickly impose limits in the capacity to analyze precisely the frame movement of a facility, whether to assist the technician in the initialization adjustment or to supervise the drive of the shed in the weaving frame.

WO-2006005599-A2 describes a heald frame pulling mechanism comprising measuring targets, for example, but does not detail the structure of these targets.

FR-2977592-A1 describes a pulling mechanism driven by a shedding machine equipped with rotating targets, for example. This device is relatively cumbersome and cannot be installed on the components of the pulling mechanism.

EP-3 341 509-A1 describes a heald frame pulling mechanism with a sensing device comprising targets machined directly into the edge of a oscillating lever, so that the targets are defined in the material and cross-section of the oscillating lever, for example. Such a sensing device is expensive, inflexible, and constrains lever construction in terms of shape, size, and means of manufacture.

The invention intends to remedy these problems in particular by proposing a pulling mechanism comprising an improved detection device that is easy and inexpensive to install and use.

To this end, the invention relates to a pulling mechanism for controlling the heald frames of a loom equipped with a shedding machine, the pulling mechanism comprising, for each heald frame:

a set of connecting rods, oscillating levers, which are coupled to the rod assembly and configured to return a movement of an exit arm or crank of the shedding machine to the heald frame, so as to drive that heald frame in a alternating motion along a frame axis, between an up and a down position, wherein the oscillating levers are associated with the heald frame and comprise a first and second oscillating lever, of which:

the first oscillating lever is pivotally mounted, in relation to the loom, about a first pivot axis orthogonal to a frame plane, the second oscillating lever is mounted so as to pivot about a second pivot axis, parallel to the first pivot axis, in relation to the loom, wherein the rod assembly comprises:

a primary rod, configured to be connected to the exit arm or crank about a first joint, which makes a pivotal connection about an rotational axis parallel to the first pivot axis, a first actuating rod, configured to be connected to a first end of the heald frame and intended to drive the heald frame in movement along the frame axis, a second actuating rod, configured to be connected to a second end of the heald frame and intended to drive the heald frame in movement along the frame axis, at least one connecting rod that connects the first oscillating lever to the second oscillating lever and which is intended to drive the second oscillating lever, wherein the first oscillating lever:

is connected to the primary connecting rod, about a second joint that makes a pivot connection about an rotational axis parallel to the first pivot axis, is intended to drive the first actuating rod via a third joint, and to drive the connecting rod via a fourth joint, the third joint and the fourth joint each making a pivot connection about a respective rotational axis parallel to the first pivot axis, wherein the second oscillating lever:

is articulated to the connecting rod, about a fifth joint, is intended to drive the second actuating rod via a sixth joint, the fifth joint and the sixth joint each making a pivotal connection about a respective rotational axis parallel to the first pivotal axis wherein the pulling mechanism comprises at least one measuring portion, equipped with a target, the target being configured to interact with a sensor.

According to the invention, each measuring portion is provided on a peripheral wall of one of the members selected from:

the first oscillating lever the second oscillating lever third oscillating lever or a stabilizer of the pulling mechanism, with the third oscillating lever or stabilizer each mounted so as to pivot in relation to the loom about a third pivot axis parallel to the first pivot axis and articulated on the connecting rod, while the target is mounted reversibly on the measuring portion.

Thanks to the invention, each measuring portion of the pulling mechanism is capable of being equipped with a measuring target, depending on the user's needs. For example, during the setting up of the loom, additional targets are installed, to make sure that the pulling mechanism is properly set. Then, during production, only some of the targets can be left in place, to monitor the performance of the loom. The targets are assembled to the oscillating levers or stabilizer, which do not need to be precisely machined and can be manufactured by conventional means such as cutting, which is economical.

According to advantageous but non-mandatory aspects of the invention, such a pulling mechanism may incorporate one or more of the following features taken alone or in any technically permissible combination:

the measuring portion comprises:

a first flank and a second flank, opposite the first flank, which between them define a median plane orthogonal to the first pivot axis, an edge, which connects the first flank to the second flank at a constant thickness, while the edge defines a receiving area, which is configured to receive the target radially to the pivot axis of the corresponding element.

The receiving area has a generally convex shape in the median plane, the measuring portion being provided:

on one end of an arm of the first oscillating lever or an arm of the second oscillating lever or an arm of the third oscillating lever, or around the first pivot axis of the first oscillating lever or the second pivot axis of the second oscillating lever or the third pivot axis of the third oscillating lever, or even on an end of the stabilizer.

The target comprises:

a target body, which extends between a first end and a second end and between two parallel edges located on either side of a longitudinal plane coinciding with the median plane when the target is mounted on the measuring portion, which comprises an inner face, configured to be mounted facing and interacting with the receiving area, and an outer face, opposite the inner face and oriented towards the sensor, the outer face being geometrically defined by a cylinder of circular cross-section and centered on a target axis, which is coincident with one of the first, second or third pivot axis corresponding to one of the elements from among the first, the second, the third oscillating lever or the stabilizer, on which the target is mounted;

two lateral flanges, which each extend parallel to the longitudinal plane from a respective edge of the body, and which are configured to bear on the first and second flanks, wherein the body and the lateral flanges delimit a receiving volume of the receiving area, the receiving volume opening out through an opening, centered on the longitudinal plane and having a width substantially equal to the thickness of the wafer, measured orthogonally to the longitudinal plane, and wherein the target is provided with mechanical connection means:

that interact with the measuring portion so as to set the target on this measuring portion, and that are arranged at each first or second end of the body and/or in the extension of the lateral flanges.

The target body is made of synthetic polymeric material, while the side flanges each comprise:

a lateral face extending parallel to the longitudinal plane, and a radial slot, provided on the lateral face up to the inner face, the radial slots being arranged in such a way that the target body is flexibly deformed by tangential bending in its longitudinal plane, when mounting or dismounting the target on the measuring portion, so as to move the mechanical connection means away from or towards each other.

The receiving area comprises complementary means for connecting to the mechanical connecting means of the target, the complementary connecting means being configured to interact with the connecting means so as to secure the target to the measuring portion.

The target comprises mechanical connecting means arranged in the extension of the two lateral flanges, spaced apart by a distance less than the thickness of the wafer, while the measuring portion comprises the complementary connecting means, which comprise recesses, formed in the first and second flanks of the measuring portion, and configured to interact with the connecting means, so as to secure the target on the measuring portion.

The inner face of the target body has a shape complementary to the receiving area and forms means of abutment to the receiving wall.

The mechanical connection means comprise:

two partitions that project from each of the first end and second end of the target body toward the opening, and two target recesses, each adjoining a partition on the side of the opening, while each of the partitions comprises an internal bulge, on the side of the opening, the internal bulges extending towards each other and defining a mouth between them, in the longitudinal plane, having a mouth width, measured parallel to the longitudinal plane, less than a receiving width measured between the two target recesses, the complementary connecting means comprising:

two radially projecting protrusions, directed away from each other, which define an outer width greater than the mouth width between them, in the median plane, and two recesses, made in the edge, each adjoining a protrusion and each forming a receiving recess for the bulge of a respective partition, the partitions and the radially projecting protrusions being configured so that each of the bulges, in an assembled configuration of the target on the measuring portion, takes position in one of the receiving recesses, while each of the protrusions takes position in one of the target recesses, and the target is configured to be disassembled from the measuring portion by reversible flexible deformation of the target body.

The mechanical connection means comprise:

two projecting partitions at each of the lower and upper ends of the target body, and two target recesses, each adjoining a partition opposite the opening, each of the partitions comprising an outer bulge, at an end away from the inner face, the two outer bulges extending opposite each other and defining between them, in the longitudinal plane:

a maximum width, measured parallel to the longitudinal plane, and a receiving width, measured between the two target recesses, that is smaller than the maximum width, while the complementary connecting means comprise:

two radially projecting protrusions, which are directed towards each other and which define an outer width, in the median plane, smaller than the maximum width of the target partitions two recesses, arranged in the edge, each adjoining a protrusion and each forming a receiving recess, the projecting partitions and protrusions being configured so that each partition in an assembled configuration of the target on the measuring portion takes position in one of the receiving recesses, while the protrusions take position in the target recesses, and the target is configured to be disassembled from the measuring portion by reversible flexible deformation of the target body.

The radially projecting protrusions and wall recesses each have a profile in respective with curvature radii greater than 2 mm, preferably greater than 5 mm.

The outer face of each target comprises at least one ferromagnetic portion and at least one non-magnetic portion, each ferromagnetic portion adjoining a non-magnetic portion of the target.

The target comprises two ferromagnetic portions of equal length, which are separated by a non-magnetic portion.

The target comprises two ferromagnetic portions of different lengths, which are separated by a non-magnetic portion.

The connecting means of the target and the complementary connecting means of the measuring portion:

are asymmetrical in relation to a transverse plane of the target, the transverse plane being radial to the target axis and determining an upper and lower target portion of similar volumes, and are configured to assemble the target to the measuring portion receiving wall in an oriented manner.

The ferromagnetic portions of each target comprise inserts made of a ferromagnetic material, such as metal, while the target body is made of a non-magnetic material, while each insert comprises an outer face, which is geometrically held by the cylinder defining the outer face of this target and the measuring portion is contained in the cylinder defining the outer face of this target.

The outer face of at least one insert is defined in the longitudinal plane of the target, between two sharp edges parallel to the target axis.

Each sensor is fixedly mounted in relation to a frame of the loom facing the target that equips the measuring portion.

The ferromagnetic and non-magnetic portion(s) of the same target together form a detection area, which extends along an angular sector greater than an angular stroke of this target when the measuring portion on which this target is mounted pivots between its high and low positions.

The invention also relates to a loom equipped with a shedding machine, the loom being equipped with a pulling mechanism as previously described.

The invention will be better understood, and other advantages thereof will become clearer in the light of the following description of five embodiments of a pulling mechanism and a loom according to the principle thereof, given by way of example only and made with reference to the appended drawings, in which.

Figure 1:
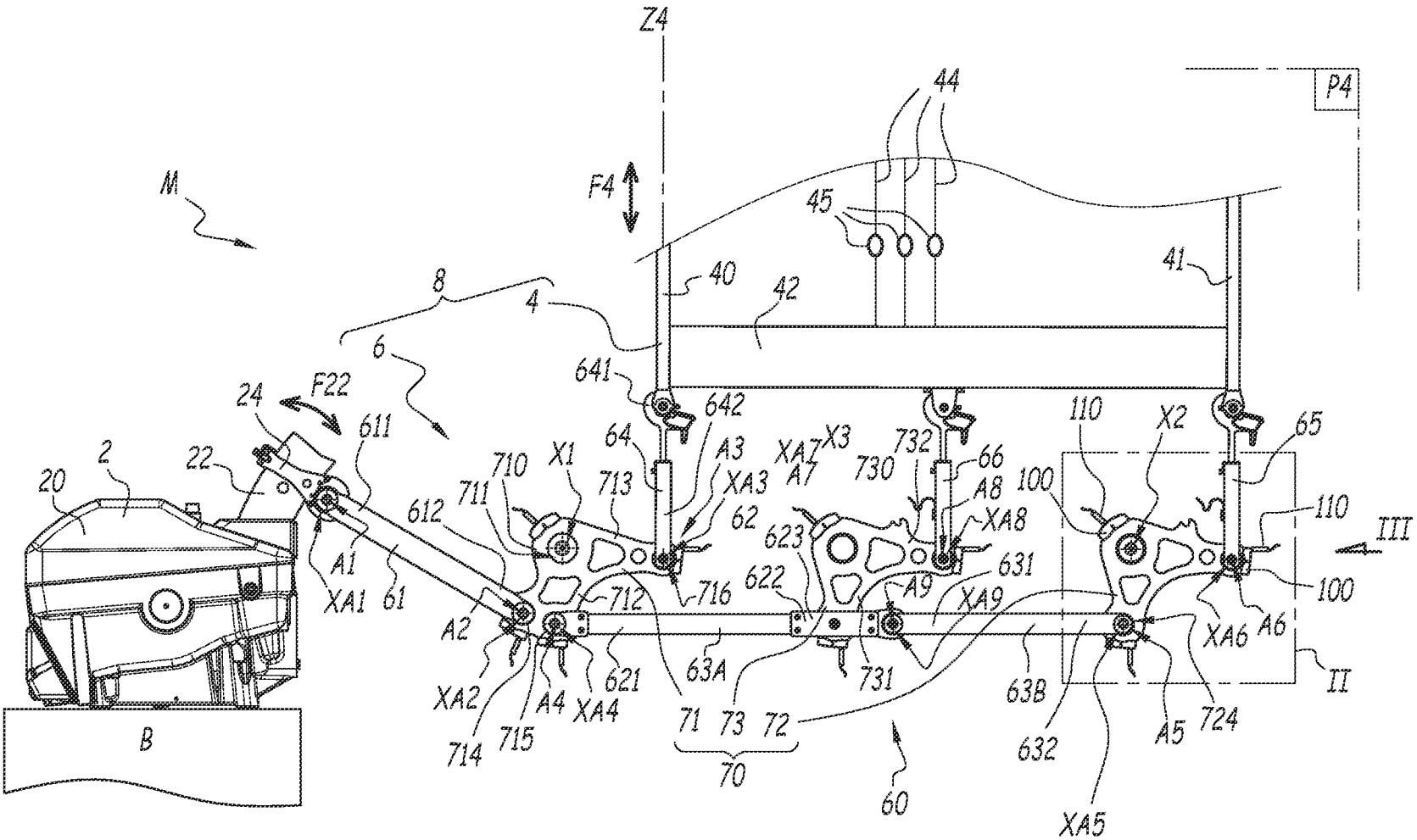
FIG. 1 is a schematic view of a loom, comprising a shedding mechanism according to a first embodiment of the invention and comprising oscillating levers equipped with measuring targets, the loom being shown in a first configuration.

FIG. 1 shows schematically a loom M. The loom M is equipped with a shedding machine 2, which drives heald frames 4 via a pulling mechanism 6. The shedding machine 2 is a cam machine.

A heald frame 4 and associated pulling mechanism 6 form a unit 8. In practice, the loom M comprises at least two assemblies 8, associating two heald frames 4 and the pulling mechanism 6, to spread the warp yarn sheets during weaving and to allow the insertion of weft yarns between the warp yarn sheets. Only one assembly 8 is shown in FIG. 1, and what is described for the assembly 8 shown is valid for other assemblies of heald frames 4 and pulling mechanisms 6 not shown.

The heald frame 4, shown here in part, has a generally rectangular shape that extends in a frame plane P4. The frame plane P4 is vertical and corresponds here to the plane in FIG. 1.

The heald frame 4 comprises a first post 40 and a second post 41, which are arranged vertically, and two horizontally arranged crossbars, with only one crossbar 42 being visible. The heald frame 4 comprises healds 44, each of which includes an eyelet 45 for receiving a warp thread of the fabric being woven. Each heald frame 4 is translatable along a vertical frame axis Z4.

The shedding machine 2 comprises a main frame 20, which is fixed in relation to a frame B of the loom M, and an exit arm 22, which is pivotally mounted in relation to the main frame 20 about an rotational axis orthogonal to the frame plane P4. The frame B is shown schematically in the figures. The rotational axis of the exit arm 22 is not shown. The exit arm 22 performs a alternating motion F22, shown by a double arrow. The shedding machine 2 also comprises a clip 24 on each exit arm 22, which allows connection to the pulling mechanism 6, the position of which along the exit arm 22 is adjustable. Once the position of the clip 24 is adjusted by a user, the clip 24 is fixed in relation to the exit arm 22.

For each heald frame 4, the pulling mechanism 6 is thus configured to return the alternating motion F22 of the exit arm 22 to the corresponding heald frame 4, so as to drive that heald frame 4 in a alternating motion F4 along the frame axis Z4, between a high and a low position. Depending on the position of the clip 24 along the exit arm 22, an operator can adjust the magnitude of the movement F4 of the heald frame 4, i.e. adjust the distance between the high and low positions of the heald frame 4.

In FIG. 1, the heald frame 4 is shown in the down position. The elements of the pulling mechanism 6 are considered non-deformable, and the assembly clearances are considered negligible. By extension, when the heald frame 4 is in the respective lowered or raised position, all the elements of the pulling mechanism 6 connected to this heald frame 4 are also said to be in the respective "lowered" or "raised position". The heald frame 4 is said to be "at the crossroads" when it is in a mid-stroke position between the lowered and the raised position. Unless otherwise specified, in the present description, all translational movements of the various elements of the pulling mechanism 4 are parallel to the frame plane P4, while all rotational movements of the elements of the pulling mechanism 4 are about axes of rotation orthogonal to the frame plane P4. In other words, all the axes of rotation are parallel to each other.

We now detail the pulling mechanism 6.

The pulling mechanism 6 comprises a set of connecting rods 60 and a set of oscillating levers 70, which are coupled to the set of connecting rods 60 and which are configured to return the alternating motion F22 of the exit arm 22 towards the heald frame 4, so as to impart the rectilinear alternating motion F4 to this heald frame 4 along the frame axis Z4.

The oscillating levers 70 comprise a first oscillating lever 71 and a second oscillating lever 72, which are associated with the heald frame 4 in pairs.

The rod assembly 60 comprises a primary rod 61, which connects the exit arm 22 to the first oscillating lever 71, a connecting rod 62, which is connected to the first oscillating lever 71 and the second oscillating lever 72 and is intended to drive the second oscillating lever 72, a first actuating rod 64, which connects the first oscillating lever 71 to the frame 4, and a second actuating rod 65, which connects the second actuating lever 72 to the frame 4.

The connecting rod 62 here is made in two parts and comprises a first connecting rod portion 63A, which is hinged to the first oscillating lever 71, and a second connecting rod portion 63B, which is hinged to the second oscillating lever 72, with the first connecting rod portion 63A and second connecting rod portion 63B being hinged together.

The first oscillating lever 71 has a body 710 with a central portion in which a main bore 711 is formed centered on a first pivot axis X1 orthogonal to the frame plane P4. The first pivot axis X1 is therefore also orthogonal to the frame axis Z4. The main bore 711 receives a bearing, configured such that the first lever 71 is pivotally mounted in relation to the loom M about the first pivot axis X1.

The first lever 71 comprises a first arm 712 and a second arm 713, each of which extends radially to the first pivot axis X1 and forms a non-zero angle between them, which is substantially orthogonal here. The first arm 712 comprises a first bore 714 at an end away from the main bore 711, and a second bore 715 adjacent thereto, each configured to receive an joint bearing defining a pivot connection along an axis parallel to the first pivot axis X1. In FIG. 1, the first bore 714 is located between the second bore 715 and the shedding machine 2.

The second arm 713 comprises a third bore 716 at an end away from the main bore 711, configured to receive a pivot bearing defining a pivot connection along an axis parallel to the first pivot axis X1.

Figure 2:
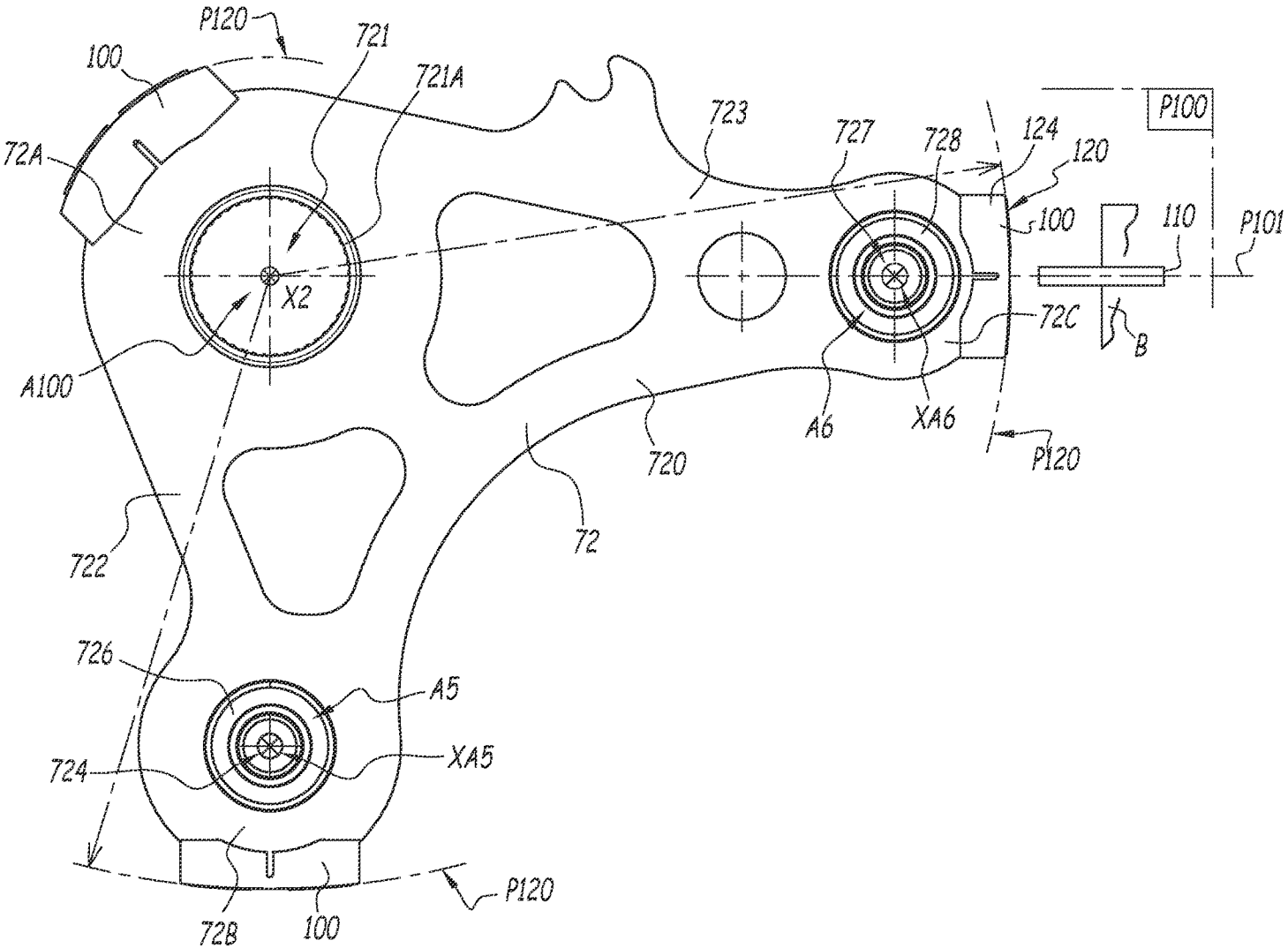
FIG. 2 is a larger scale view of the oscillating lever and a sensor visible in box II in FIG. 1.

The second oscillating lever 72, which is also shown in FIG. 2, has a body 720 with a central portion in which a circular main bore 721 is formed, centered on a second pivot axis X2 that is parallel to the first pivot axis X1. The main bore 721 receives a bearing 721A, the second lever 72 being mounted pivoting in relation to the loom M about the second pivot axis X2.

The second lever 72 comprises a first arm 722 and a second arm 723, which extend radially to the second pivot axis X2 and form a non-zero angle between them, which is substantially orthogonal here. The first arm 722 of the second lever 72 includes a first bore 724 at an end away from the central portion, configured to receive a pivot bearing 726 defining a pivot connection along an axis parallel to the second pivot axis X2.

The second arm 723 of the second lever 72 comprises a second bore 727 at an end away from the central portion, configured to receive a second joint bearing 728 defining a pivot connection along an axis parallel to the second pivot axis X2.

The primary rod 61 has an elongated shape with opposing first end 611 and second end 612. The first end 611 here is clevis-mounted on a bearing of the clip 24, so as to form a first joint A1 between the primary rod 61 and the clip 24. The first joint A1 is a pivot connection about a first rotational axis XA1. In other words, the primary rod 61 is configured to be connected to the exit arm 22 about the first joint A1. In the use configuration, as shown in FIG. 1, the first rotational axis XA1 is parallel to the first pivot axis X1.

The second end 612 of the primary connecting rod 61 is clevis-mounted on the joint bearing received in the first bore 714 of the first oscillating lever 71, so as to form a second joint A2, which is a pivot connection about a second rotational axis XA2. In other words, the primary connecting rod 61 is configured to be connected to the first oscillating lever 71 about the second joint A2. In the use configuration, the second rotation axis XA2 is parallel to the first pivot axis X1.

The first actuating rod 64 has an elongated shape, with a first end 641, which has a hook shape here, and a second end 642 opposite the first end 641.

The first end 641 is configured to be connected to the heald frame 4 and is intended to drive the heald frame 4 in motion F4 along the frame axis Z4. The first end 641 is connected here to a bottom portion of the first post 40 of the heald frame 4, corresponding to a first end of the heald frame 4.

The second end 642 of the first actuating rod 64 is clevis-mounted on the hinge bearing received in the third bore 716 of the first oscillating lever 71, so as to form a third hinge A3, which is a pivot connection about a second rotational axis XA3. In the use configuration, the third rotational axis XA3 is parallel to the first pivot axis X1.

The first portion of the connecting rod 63A has an elongated shape with opposing first end 621 and second end 622. The first end 621 is here clevis-mounted on the pivot bearing received in the second bore 715 of the first oscillating lever 71, so as to form a fourth joint A4 between the first connecting rod 63A and the first oscillating lever 71. The fourth joint A4 is a pivot connection about a fourth rotational axis XA4. In other words, the first rod portion 63A is configured to be connected to the first oscillating lever 71 about the fourth joint A4. In the use configuration, as shown in FIG. 1, the fourth rotational axis XA4 is parallel to the first pivot axis X1.

The second connecting rod portion 63B has an elongated shape with a first end 631, which is connected to the second end 622 of the first connecting rod 63A, and a second end 632 opposite the first end 631, which is here clevis-mounted on the hinge bearing 726 received in the first bore 724 of the second oscillating lever 72, so as to form a fifth joint A5 between the second connecting rod 63B and the second oscillating lever 72. The fifth joint A5 is a pivot connection about a fifth rotational axis XA5. In other words, the second connecting rod 63B is configured to be connected pivoting to the second oscillating lever 72 about the fifth joint A5. In the use configuration, as shown in FIG. 1, the fifth rotational axis XA5 is parallel to the first pivot axis X1.

The second actuating rod 65 is similar, preferably identical, to the first actuating rod 64, and operates in a similar manner. The second actuation rod 65 is configured to be connected to a second end of the heald frame 4, here to a lower portion of the second post 41 of the heald frame 4. The second actuating rod 65 is intended to drive the heald frame 4 in movement F4 along the frame axis Z4, together with the first actuating rod 64. The heald frame 4 is thus driven at both ends, which balances the driving forces to which the heald frame 4 is subjected, so that the vertical movement of each end of the frame is similar.

The second actuating rod 65 comprises a first hook-shaped end 615 connected to the heald frame 4, and a second end 652 opposite the first end 651, clevis-mounted on the second hinge bearing 728 received in the second bore 727 of the second oscillating lever 72, so as to form a sixth hinge A6, which is a pivotal connection about a sixth rotational axis XA6. In the use configuration, as shown in FIG. 1, the sixth rotational axis XA6 is parallel to the first pivot axis X1.

The second oscillating lever 72 is similar or even identical to the first oscillating lever 71. In particular, and advantageously, the second lever 72 has the same joint geometry and height at ground level as the first oscillating lever 71, so that the pivots of the first lever 71 and the second lever 72 are similar, and the vertical movements of the actuating rods 64 and 65 respectively hinged thereto are identical. In particular, the respective fourth and fifth joints, A4 and A5, are spaced from the respective pivot axes, X1 and X2, by an equal distance. The third and sixth joints A3 and A6 are spaced from the respective pivot axes, X1 and X2, by an equal distance.

In the illustrated example, the pulling mechanism 6 also includes a third oscillating lever 73. The third oscillating lever 73, located between the first oscillating lever 71 and the second oscillating lever 72, contributes in particular to a good distribution of the forces transmitted to the heald frame 4.

The third oscillating lever 73 is similar, preferably identical, to the second oscillating lever 72. The third oscillating lever 73 comprises a body 730 with a central portion, in which a bore is provided centered on a third pivot axis X3, parallel to the first pivot axis X1. The third lever includes a first arm 731 and a second arm 732, which extend radially to the third pivot axis X3 and are substantially orthogonal to each other here.

In the illustrated example, the second end 622 of the first connecting rod 63A includes an attachment portion 623, to which the first arm 731 of the third oscillating lever 73 is connected, so as to form a seventh joint A7, which is a pivot connection about a seventh rotational axis XA7. The seventh rotational axis XA7 is parallel to the first pivot axis X1.

The second arm 732 of the third oscillating lever 73 is connected to the heald frame 4 via a third actuating rod 66. The third actuating rod 66 is similar, preferably identical, to the first and second actuating rods 64 and 65. The third actuating rod 66 is articulated rotatably in relation to the third oscillating lever 73, about an eighth joint A8. The eighth joint A8 defines a pivotal connection about an eighth rotational axis XA8, which is parallel to the first pivot axis X1 in the use configuration of the pulling mechanism 6.

The first end 631 of the second connecting rod 63B here is clevis-mounted on a bearing provided in the second end 622 of the first connecting rod 63A, so as to provide a ninth joint A9, which is a pivotal connection about a ninth rotational axis XA9. The ninth rotational axis XA9 is parallel to the first pivot axis X1. In other words, the first connecting rod 63A and the second connecting rod 63B are interconnected about the ninth joint A9, making a pivotal connection about the rotation axis XA9 parallel to the first pivot axis X1.

In summary, the three oscillating levers 71, 72, and 73 each pivot about a respective pivot axis X1, X2 and X3. The pivot axes X1 through X3 are parallel to each other and orthogonal to the frame plane P4. The rod assembly 60 and the lever assembly 70 here define nine joints, referenced A1 through A9, each of which are pivotal connections about a respective rotational axis. These rotational axes, referenced XA1 to XA9, are parallel to each other and orthogonal to the frame plane P4.

When the frame 4 exhibits an alternating motion F4 between the high and low positions, each of the elements comprising the rod assembly 60 and the lever assembly 70 also moves between its respective high and low positions. In particular, the oscillating levers 71, 72, and 73 oscillate about their respective pivot axes in the frame plane P4, so that the angular position of one of these elements in the frame plane P4 is significant data on the positioning of the pulling mechanism 6 and the position of the heald frame 4. Thus, it is possible to monitor the overall operation of the pulling mechanism 6 by measuring the position of one or more of the levers and connecting rods of the lever assemblies 70 and rod assemblies 60.

The pulling mechanism 6 is thus equipped with measurement targets 100 and sensors 110. Each target 100 is associated with a respective sensor 110. Each target 100 is mounted on an element of the pulling mechanism 4 and is therefore movable, while each sensor 110 is mounted stationary in relation to the frame B of the loom M facing the associated target 100.

According to the position of the sensor 110 facing the corresponding target 100, this sensor 110 is able to interact with the target 100 when the element of the pulling mechanism 4 on which the target 100 is mounted reaches one of the high, low or intermediate positions, or, in other words, the sensor interacts with the target 100 of the measuring portion 72C on which this target 100 is mounted, in a known pulling mechanism position, and in particular this sensor 110 is able to notify the loom that the mechanism element has reached the known position corresponding to a predetermined heald frame height 4. In other words, the sensor 110 is mounted on the loom M in one of the positions selected from a high, low position or intermediate position of the measuring portion 72C, in at least one of which the sensor is adapted to interact with the target 100.

The sensor 110 connected to the loom thus transmits signals that a controller is able to interpret, such as to determine the direction of rotation, the angular variation of the oscillation, the position, speed or acceleration of the equipped pulling element.

With the knowledge of the geometrical configuration of the pulling mechanism at the frame, the angles and length of its constituent parts, this measurement collection makes it possible to interpretation the stroke at the frame, the shed height, its speed or acceleration in the weaving cycle.

Also, recording the frame status participates in the knowledge, prediction, and refinement of models of the machine, in order to prevent mechanical incidents, for example. Equipping several pulling mechanism elements makes it possible to control of several moving frames simultaneously. Interpretation of these signals can provide knowledge of the profile or even the weave being woven.

In the following, primarily the positioning of the targets 100 on the elements of the pulling mechanism 6 is considered, with the presence of the sensor 110 associated with this target 100 implied when the user wishes to perform measurements.

As illustrated in FIG. 1 or, on a larger scale, in FIG. 2, several targets 100 may be mounted on a single element of the pulling mechanism 6. The targets 100 are preferably mounted on the oscillating levers 71, 72 or 73.

In the illustrated example, the first oscillating lever 71 is equipped with four targets, while the second oscillating lever 72 and the third oscillating lever 73 are each equipped with three targets 100, this number being variable according to the user's needs. A portion of an element of the pulling mechanism 6 on which a target 100 is mounted is referred to as a measuring portion. The position of each element of the pulling mechanism 6 is thus monitored when a target 100 is mounted on a measuring portion of this element of the pulling mechanism 6. Advantageously, the measuring portion is contained in and tangent with a continuous convex envelope of the pulling mechanism element 6 on which the measuring portion is provided, as explained below.

Each measuring portion here is provided on one of the oscillating levers 71 to 73, more specifically on a peripheral wall of one of the oscillating levers 71 to 73. In other words, each measuring portion is provided at a distance from the pivot axis X1, X2 or X3 corresponding to this oscillating lever 71, 72 or 73 and has an alternating rotational movement about this axis X1, X2 or X3 when the heald frame 4 is in alternating motion F4.

The remainder of the description is made in relation to targets 100 mounted on the second oscillating lever 72, shown in FIG. 2. What is described for one target 100 mounted on the second oscillating lever 72 is transposable to other targets 100 mounted on other elements of the pulling mechanism 6, such as those mounted on one of the elements of the connecting rod assembly 60.

The second oscillating lever 72 comprises a first measuring portion 72A, closer to the main bore 721 than to the first and second bores 724 and 727, a second measuring portion 72B, provided on the first arm 722 at the end away from the main bore 721, and a third measuring portion 72C, provided on the second arm 723 at the end away from the main bore 721.

Each target 100 is mounted reversibly on the corresponding measuring portion 72A through 72C as described below. Thus, depending on his or her needs and depending on the accessibility of the measuring portions, the user may increase or decrease the number of targets 100 fitted to the pulling mechanism 6. The user can consider equipping a measuring portion temporarily, or permanently, or also increase knowledge of the loom thanks to this new equipment during a maintenance operation, or finally before starting the loom for a weaving cycle.

Advantageously, the target 100 can be chosen for its intrinsic characteristics according to the application, the pulling mechanism or the loom it equips. Also, the element of the pulling mechanism 6 and the measuring portion of the element to be equipped can be chosen according the possible accessibility.

In FIG. 2, a single sensor 110 is shown facing the target 100 mounted on the third measuring portion 72C. This target 100 has a target body 124 with an outer face 120, which faces the sensor 110.

Figure 5:
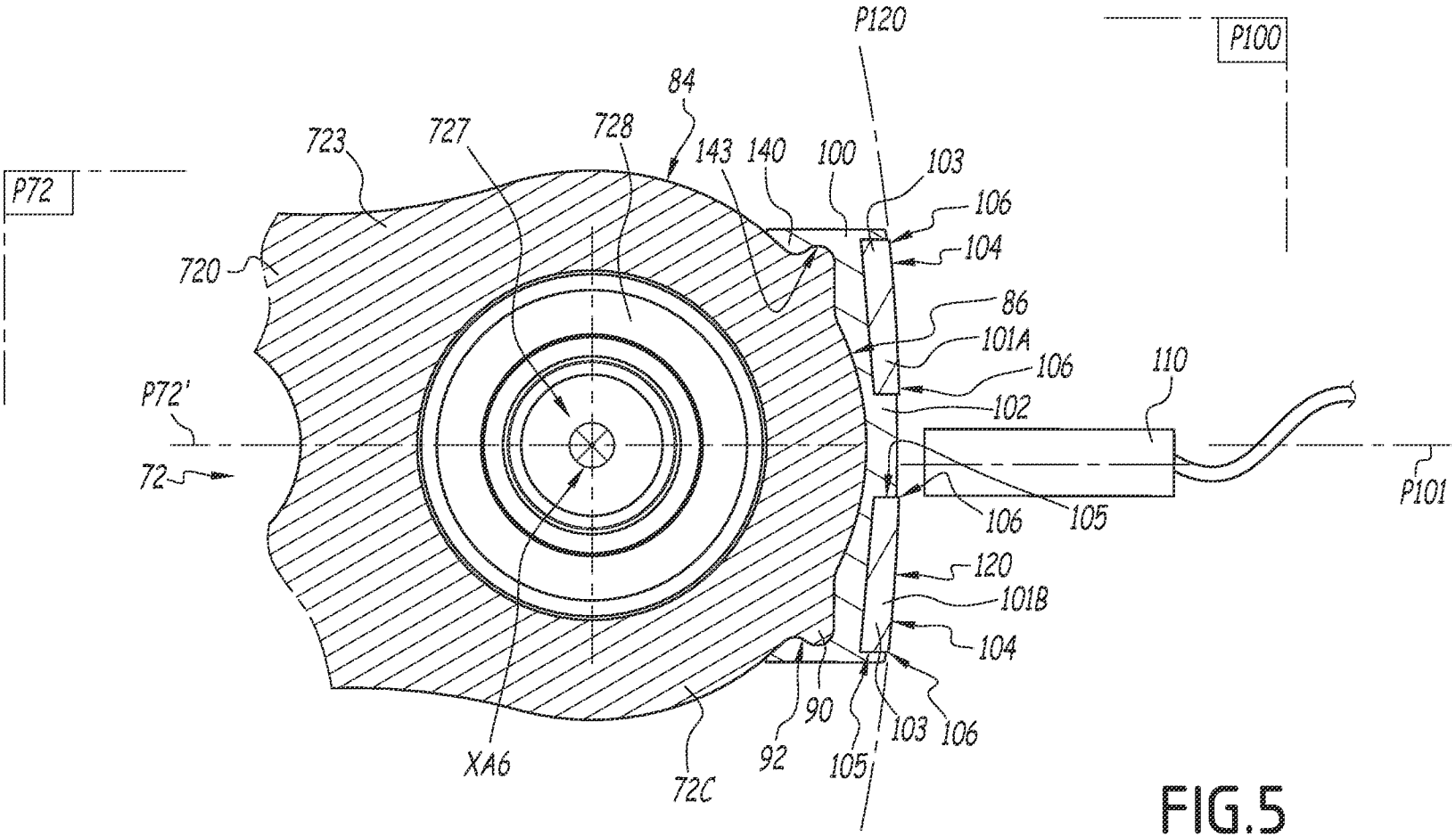
FIG. 5 is a cross-section of the oscillating lever and the measuring target shown in an assembled configuration, according to plane V in FIG. 3.

The outer face 120 is geometrically defined by a cylinder P120 with a circular cross-section, centered on a target axis A100. The outer face 120 is held by the cylinder P120. In a variant, the outer face 120 may be substantially offset from this cylinder P120, or partially defined in relation to this cylinder P120 such that the entire outer face 120 is not strictly held by the cylinder P120. In FIG. 5, the target 100 is mounted on the second oscillating lever 72, and the target axis A100 is coincident with the second pivot axis X2 corresponding to the second oscillating lever 72. For convenience, a longitudinal plane P100 of the target 100 is defined as a plane orthogonal to the target axis A100, and a transverse plane P101 of the target 100 is defined as a plane orthogonal to the longitudinal plane P100 and containing the target axis A100.

Thus, a distance between the outer face 120 and the opposing sensor 110 remains constant as the oscillating lever 72, and thus the target 100, moves between its high and low positions, which contributes to good measurement accuracy.

More generally, when a target 100 is mounted on a measuring portion of one of the oscillating levers 71, 72 or 73, then the outer face 120 of this target 100 is geometrically defined by a cylinder P120 of circular cross-section and centered that one of the first, second or third pivot axes X1, X2 or X3 corresponding to that one of the elements among the first lever 71, the second lever 72 or the third lever 73 on which the target 100 is mounted.

The structure and mounting of a target 100, mounted on the measuring portion 72C, is now described in detail with reference to FIGS. 3 to 6. What is described is transposable to targets 100 mounted on other measuring portions.

The sensor 110, which is stationary, is configured to detect an angular position and/or movements of the facing outer face 120 of the target 100. Several sensor technologies can be used, including optical sensors, ultrasonic sensors, etc. Advantageously, the sensors 110 are magnetic field sensors, such as induction sensors, which are particularly well suited to the environment of a loom M, as the magnetic fields generated by the sensor 110 and/or the facing target 100 are not disturbed by dust that might get between the sensor 110 and the facing target 100.

Figure 3:
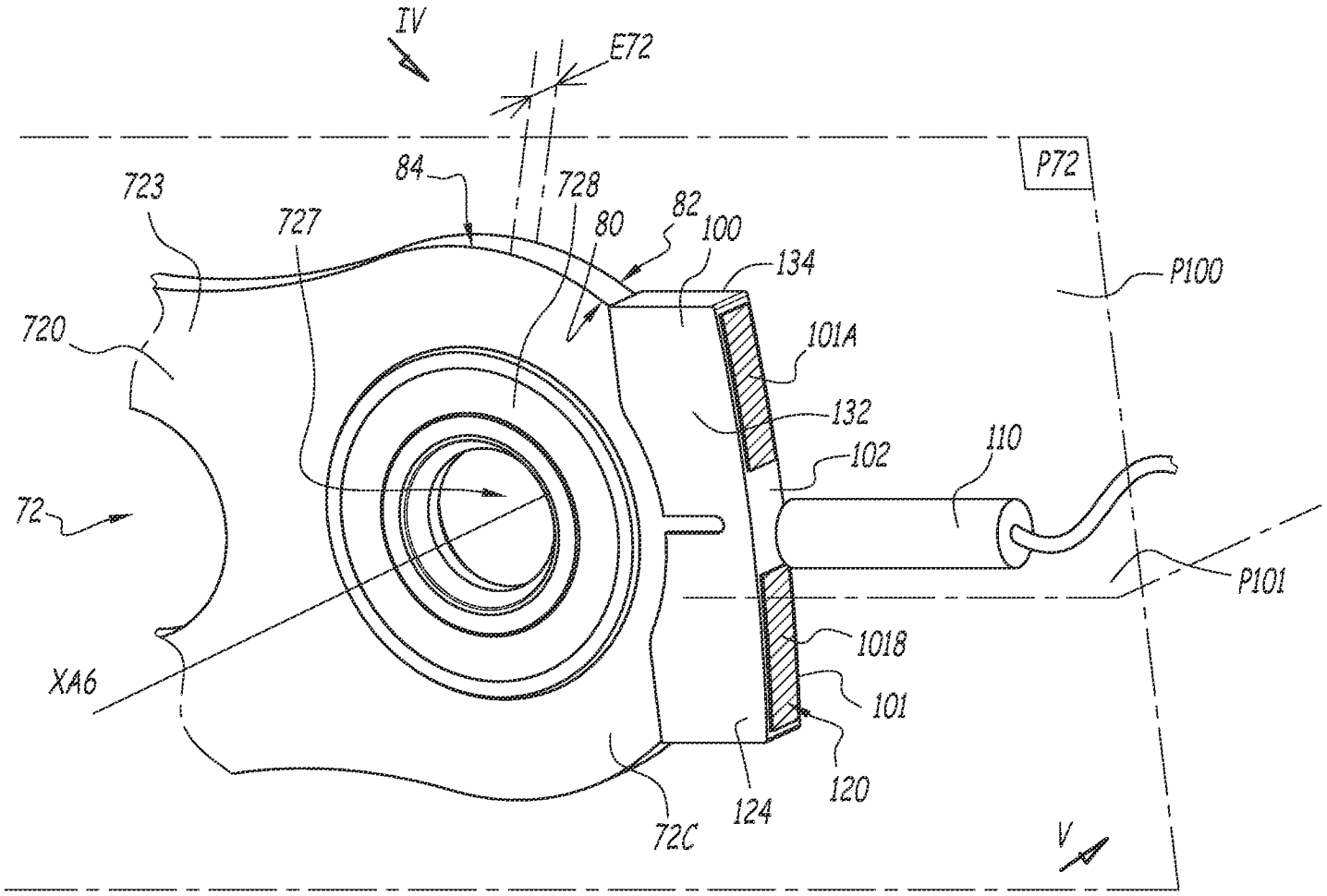
FIG. 3 is a partial perspective view of the oscillating lever and sensor of FIG. 2, viewed according to arrow III in FIG. 1 and shown in a second configuration.
Figure 4:
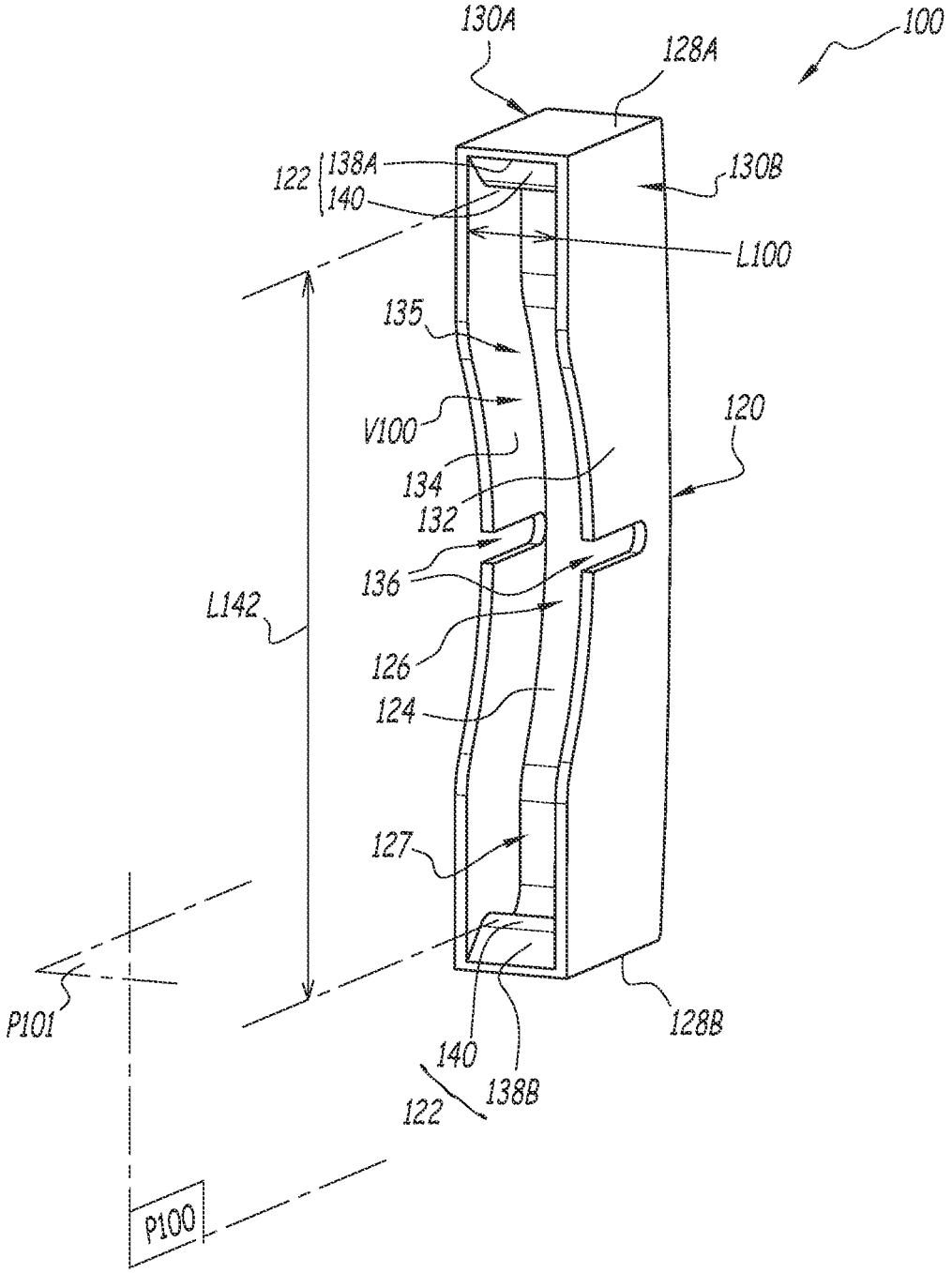
FIG. 4 is a perspective view of the measurement target, according to arrow IV in FIG. 3.

As visible in FIG. 3, the outer face 120 comprises an upper ferromagnetic portion 101A, a lower ferromagnetic portion 101B, and a non-magnetic portion 102. The ferromagnetic portions 101A and 101B, which are shown hatched, have the same length here, measured parallel to the longitudinal plane P100 of the target 100, and are separated by the non-magnetic portion 102. The upper ferromagnetic portion 101A and the lower ferromagnetic portion 101B are generically referred to as "ferromagnetic portions 101".

Thus, when the target 100 moves alternately between its upper position and its lower position, the opposite sensor 110 sees the ferromagnetic 101 and non-magnetic 102 portions pass alternately in front of it, which makes it possible to detect the movements of the oscillating lever 72. Advantageously, the ferromagnetic portions 101 extend over more than 5 mm, for example 15 mm, which allows the controller of the loom M to clearly grasp the signals from the sensor 110 and differentiate the ferromagnetic portion 101 from the non-magnetic portion 102, to then interpret a magnetic field change as an angular movement of the measuring portion 72C.

The high, low, and intermediate positions of the measuring portion 72C correspond to a respective high, low or intermediate position of the heald frame 4.

In the position illustrated in FIGS. 2 and 3, the sensor 110 is located opposite the non-magnetic portion 102, which means that the second oscillating lever 72 is in an intermediate position between its high position and its low position. When the second oscillating lever 72 is in its respectively lower or upper position, the respective upper ferromagnetic portion 101A or lower ferromagnetic portion 101B, is located opposite the sensor 110.

More generally, a single ferromagnetic portion 101 adjacent to a non-magnetic portion 102 is sufficient for the sensor 110 to detect the movement of the facing target 100. The outer face 120 facing a sensor 110 thus includes at least one ferromagnetic portion 101 and at least one non-magnetic portion 102, while each ferromagnetic portion 101 adjoins a non-magnetic portion of the target 100.

Advantageously, each target 100 comprises several ferromagnetic portions 101, separated by one or more non-magnetic portions 102, which makes it possible to know the position of the second oscillating lever 72 more precisely.

Regardless of their number, the ferromagnetic portion(s) 101 and the non-magnetic portion(s) 102 of the same target 100 together form a detection area, which advantageously extends along an angular sector greater than an angular stroke of the target 100 when the measuring portion 72C passes from its high position to its low position. In other words, the detection area of a target 100 is sufficiently large so that the sensor 110 facing this target is always facing the detection area when the target 100 moves between its high and low positions, regardless of the measuring portion 72A, 72B or 72C on which the target 100 is mounted.

The upper 101A and lower 101B ferromagnetic portions are shown in cross section in FIG. 5. In the first embodiment of the invention, each of the ferromagnetic portions 101A and 101B is made by an insert 103. The two inserts 103 of the first embodiment of the invention are similar to each other, preferably identical. Each insert 103 here has a substantially parallelepiped shape, with a convex outer face 104, and is received in a housing provided in the target body 124 of the target 100. Each insert 103 is made of a ferromagnetic material such as a metallic material, while the non-magnetic portion 102 is a portion of the target body 124. The target body 124 here is made entirely of a non-magnetic material.

The outer face 104 of each insert 103 is configured to face the associated sensor 110. The outer face 104 of an insert 103 is geometrically contained within the cylinder P120 associated with the outer face 120 of the target body 124.

In the illustrated example, the outer face 104 of an insert 103 is geometrically merged with the outer face 120 of the target body 124. In other words, the outer face 104 of each insert 103 is geometrically held by the cylinder P120 of circular cross-section centered on a target axis A100, the target axis A100 here being coincident with the second pivot axis X2.

In a variant, not shown, the outer faces 104 of the inserts 103 of a target 100 are tangent with the cylinder P120 and each have a radius smaller than a radius of the cylinder P120, so that the outer faces 104 are not strictly coincident with the cylinder P120 but remain contained within the cylinder P120.

Each insert 103 comprises two facets 105, which border the outer face 104 and are orthogonal to the longitudinal plane P100. On each insert 103, each facet 105 forms an edge 106 with the outer face 104 of this insert 103. Each edge 106 is preferably orthogonal to the longitudinal plane P100, i.e. parallel to the target axis A100.

For each insert 103, each edge 106 adjacent to a non-magnetic portion 102 is advantageously a sharp edge. A "sharp" edge means that each edge 106 has a radius of curvature of less than 1 mm, preferably less than 0.5 mm, more preferably less than 0.1 mm, so as to improve the ability of the sensor 110 to differentiate the ferromagnetic portions 101 from the adjacent non-magnetic portions 102. In other words, the outer face 104 of each insert 103 extends between two sharp edges 106 parallel to the target axis A100, in the longitudinal plane P100 of the target 100.

Advantageously, the measuring portion 72C is contained within the cylinder P120 geometrically carrying the outer face 104 of each insert 103. In other words, when the target 100 is mounted on the measuring portion 72C, the measuring portion 72C is recessed from the cylinder P120 geometrically carrying the outer face 104 of each insert 103, so as to not interfere with the opposing sensor 110 when the oscillating lever 72 pivots between its upper and lower positions.

Each target 100 insert 103 arranged on a measuring portion 72C of a peripheral wall of an element of the pulling mechanism 6 shows a configuration of the pulling mechanism 6, in association with the opposing sensor 110, between its high and low positions.

Advantageously, a target 100 can be selected according to the number of inserts 103 or according to the nature of its inserts 103 for specific measurement needs. Thus, the shape, the nature of the material used for the measurement, etc., can be chosen independently of the properties of the edge of the oscillating lever whose movement is to be analyzed.

In the example shown in FIGS. 2 to 6, the second oscillating lever 72, and thus also the measuring portion 72C, are formed in a metal plate, preferably of steel, which comprises a first flank 80 and a second flank 82 opposite the first flank 80, visible in FIG. 3. The first flank 80 and the second flank 82 define a median plane P72 between them, orthogonal to the second pivot axis X2. When the target 100 is mounted on the measuring portion 72C, the longitudinal plane P100 is coincident with the median plane P72 of the measuring portion 72C.

The first flank 80 and the second flank 82 are connected by a wafer 84, which has a closed contour and a constant thickness E72. The wafer 84 is thus a peripheral wall of the second oscillating lever 72. In other words, the measuring portion 72C has the thickness E72 of the oscillating lever, and on the wafer 84 of the oscillating lever.

Figure 6:
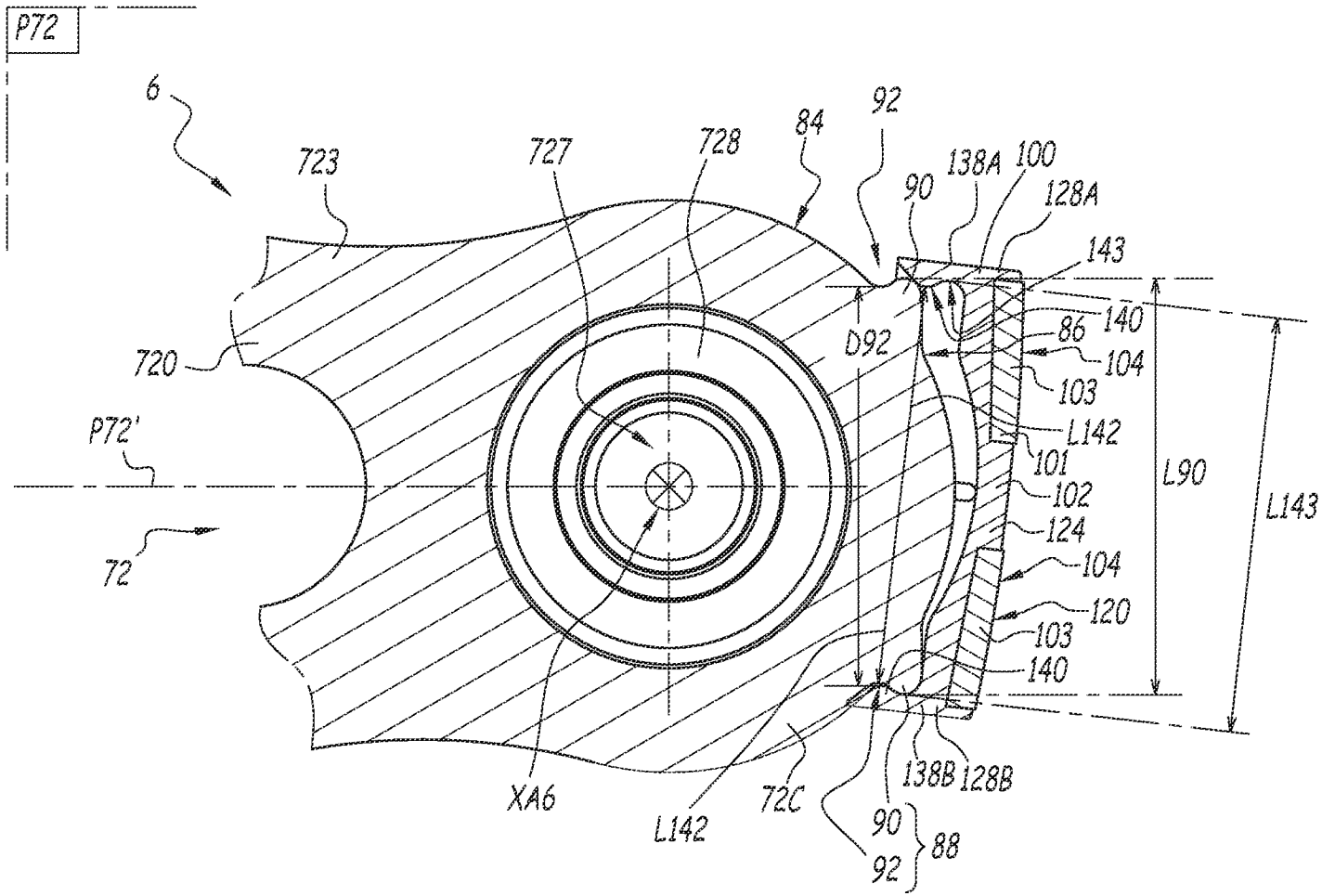
FIG. 6 is a section analogous to FIG. 5, with the oscillating lever and the measuring target shown in a configuration during assembly, called the "assembly configuration"

The wafer 84 comprises a receiving area 86, visible in FIGS. 5 and 6, which is configured to receive the target 100 radially at the second pivot axis X2, in whole or in part. The receiving area 86 comprises complementary connecting means 88, which are configured to interact with connecting means 122 of the target 100, so as to mechanically secure the target 100 to the measuring portion 72C. The connecting means 122 are discussed in more detail below.

The complementary connecting means 88 here comprise two protrusions 90, which are provided protruding from the receiving area 86. The receiving area 86 has a generally convex shape in the median plane P72, so that the wafer 84 defines a uniform material thickness around the joint A6 configured to receive the target 100. The two protrusions 90 extend radially to the second pivot axis X2, are directed away from each other and define an outer width L90 between them, in the median plane P72. Each protrusion 90 adjoins a recess, provided in the wafer 84, which forms a receiving recess 92 configured to interact with the connecting means 122. In the first embodiment of the invention, the two protrusions 90 are located between the two receiving recesses 92, the two receiving recesses 92 being oriented opposite each other. A distance D92 between the bottoms of the two receiving recesses 92, measured in the median plane P72 parallel to the width L90, is strictly smaller than the outer width L90 of the two protrusions 90.

The target 100 has a generally symmetrical shape, both in relation to the longitudinal plane P100 and in relation to the transverse plane P101.

The target body 124 of the target 100 is generally shaped like a slightly domed, flattened parallelepiped, with the outer face 120 of the target 100 corresponding to a convex face of this parallelepiped. The target body 124 also comprises an inner face 126 opposite of the outer face 120. The inner face 126 is configured to be mounted facing and interacting with the receiving area 86.

The target body 124 extends along an angular sector centered on the target axis A100, between an upper end 128A and a lower end 1288. The upper end 128A and lower end 1288 are located on opposite sides of the transverse plane P101.

The target body 124 also comprises two edges 130A and 130B on either side of the longitudinal plane P100, which are each geometrically held by a plane parallel to the longitudinal plane P100. The target body 124 also comprises two lateral flanges 132 and 134, each of which extends parallel to the longitudinal plane P100 from a respective edge 130A or 130B of the body 124 on the side of the inner face 126. The two lateral flanges 132 and 134 are configured to bear on the respective first flank 80 and second flank 82.

The target body 124 and lateral flanges 132 and 134 together delimit a volume V100 for receiving the receiving area 86. The receiving volume V100 comprises a bottom 127, which includes the inner face 126 of the target body 124. The inner face 126 has a shape complementary to that of the receiving area 86. When the target 100 is mounted on the measuring portion 72C, the bottom 127 forms means to abut the receiving area 86.

The receiving volume V100 opens through an opening 135 opposite the bottom 127, is centered on the longitudinal plane P100 and has a width L100 substantially equal to the thickness E72 of the wafer 84, measured orthogonally to the longitudinal plane P100.

The lateral flanges 132 and 134 each comprise a radial slot 136, provided radially to the target axis A100 and extending to a junction between the corresponding lateral flange 132 or 134 and the target body 124. In other words, the radial slots 136 extend into the side flanges 132 and 134 to the inner face 126. Here, the radial slots 136 are provided astride the transverse plane P101.

The target 100 comprises two partitions 138A and 1388, which extend from each of the respective upper 128A and lower 1288 ends of the target body 124. The two partitions 138A and 138B extend on the same side as the receiving volume V100 and are both adjacent to the bottom 127. Each of the partitions 138A or 138B connects the side flanges 132 and 134 together.

Each of the partitions 138A or 138B comprises an internal bulge 140 at an end away from the bottom 127, which extends into the receiving volume V100. The bulges 140 extend towards each other and define a mouth 142 between them, in the longitudinal plane P100, narrowed in relation to the opening 135. A distance between the two bulges 140, measured parallel to the longitudinal plane P100, defines a mouth width L142 of the target 100.

Each of the bulges 140 abuts a target recess 143, which is provided on the corresponding partition 138A or 138B between the bulge 140 and the bottom 127 on the side of the receiving volume V100. The two target recesses 143 are separated by a receiving width L143, measured between the two target recesses 143 parallel to the longitudinal plane P100 and the mouth width L142. The receiving width L143 is strictly larger than the mouth width L142.

In practice, the receiving width L143 is between 20 mm and 80 mm, preferably between 40 and 50 mm, more preferably of the order of 48 mm, whereas the mouth width L142 is between 20 mm and 80 mm, preferably between 40 and 50 mm, more preferably of the order of 44 mm.

The receiving width L143 with assembly clearances is equal to the outer width L90 of the measuring portion 72, while the distance D92 between the bottoms of the two receiving recesses 93 with assembly clearances is equal to the mouth width L142. In other words, the mouth width L142 is less than the receiving width L143 of the receiving volume V100 and the outer width L90.

In FIG. 5, the target 100 is shown in an assembled configuration on the measuring portion 72C. The partitions 138A and 1388, on the one hand, and the radially projecting protrusions 90, on the other hand, are configured so that the bulges 140 take position in the space defined by the receiving recesses 92, while the receiving area 86, received in the receiving volume V100, abuts against the bottom 127.

In other words, in the first embodiment of the invention, the complementary connecting means 88 comprise the protrusions 90 and the receiving recesses 92, while connecting means 122 of the target 100 comprise the partitions 138A and 1388, on which the bulges 140 are provided.

The radially projecting protrusions 90 and the receiving recesses 92 each have a profile with respective radii curvature greater than 2 mm, preferably greater than 5 mm. The measuring portion 72C is thus easy to manufacture, particularly by cutting, and does not require the use of an additional precise machining method for mounting the target 100.

A sequence for mounting the target 100 on the measuring portion 72C is now described.

Advantageously, the target 100 is mounted on the second lever 723 of the lever 72 arranged in the up position, while the adjacent levers are in the down or crossing position.

First, the operator approaches the target 100 of the measuring portion 72C, with the longitudinal plane P100 aligned with the median plane P72 and the opening 135 of the receiving volume V100 oriented towards the measuring portion 72C. The operator introduces one of the protrusions 90 into the receiving volume V100, so that one of the bulges 140 is received in the receiving recess 92 adjacent to this protrusion 90.

The target 100 and the measuring portion 72C are then in the assembly configuration of FIG. 6, in which the target 100 is being mounted on the measuring portion 72C.

As the operator exerts a force on the target 100 substantially orthogonal to the outer face 120, the target body 124 flexibly deforms to accommodate the passage of the receiving area 86. During this movement, the partitions 138A and 138B are moved away from each other by a width greater than the outer width L90.

As the movement continues, the receiving area 86 comes to abut the bottom 127 and the bulges 140 are each received in a respective receiving recess 92. The target 100 is then in its assembled configuration, shown in FIG. 5.

To facilitate flexible deformation of the target body 124, the radial slots 136 are arranged so that, when the target is mounted or dismounted on the corresponding measuring portion 72C, the target body 124 deforms flexibly by tangential bending in its longitudinal plane P100, so as to move the mechanical connection means 122 away from each other. The partitions 138A and 138B are moved apart by flexible deformation of the target body 124, so as to cross the protrusions 90 of the measuring portion 72C. For this purpose, the target body 124 is made of a material capable of flexible deformation, preferably of a synthetic polymeric material such as polyethylene, polypropylene, silicone, or an elastomer. The target body 124 is made by plastic injection molding in a complementary shaped mold, for example. The target 100 is thus assembled on the measuring portion 72C by hand, without tools.

In the assembled configuration, the target 100 is held by the flexibility of the body 124 on the measuring portion 72C. In other words, the target 100 is held clipped or held by clipping to the measuring portion 72C, so that the target 100 remains in the assembled configuration during operation of the loom M, in particular when the measuring portion 72C performs oscillating movements about the second pivot axis X2 and the target 100 is subjected to centrifugal forces.

Disassembly takes place in a reverse motion. The operator exerts a force on the target 100 that tends to move the target away from the measuring portion 72C. By flexible deformation of the target body 124, the partitions 138A and 138B move apart, to accommodate the passage of the receiving area 86 and the protrusions 90. Disassembly is also done by hand and without tools. The target 100 can be reversibly assembled and disassembled as needed for equipping in a limited time, and without limit of repetition, since the target 100 is configured to be disassembled from the measuring portion 72C by reversible flexible deformation of the target body 124.

In the second through fifth embodiments of the invention illustrated in FIGS. 7 through 12, the elements similar to those in the first embodiment bear the same references and operate in the same manner. In what follows, primarily differences between each embodiment and the preceding embodiment(s) are described.

Figure 7:
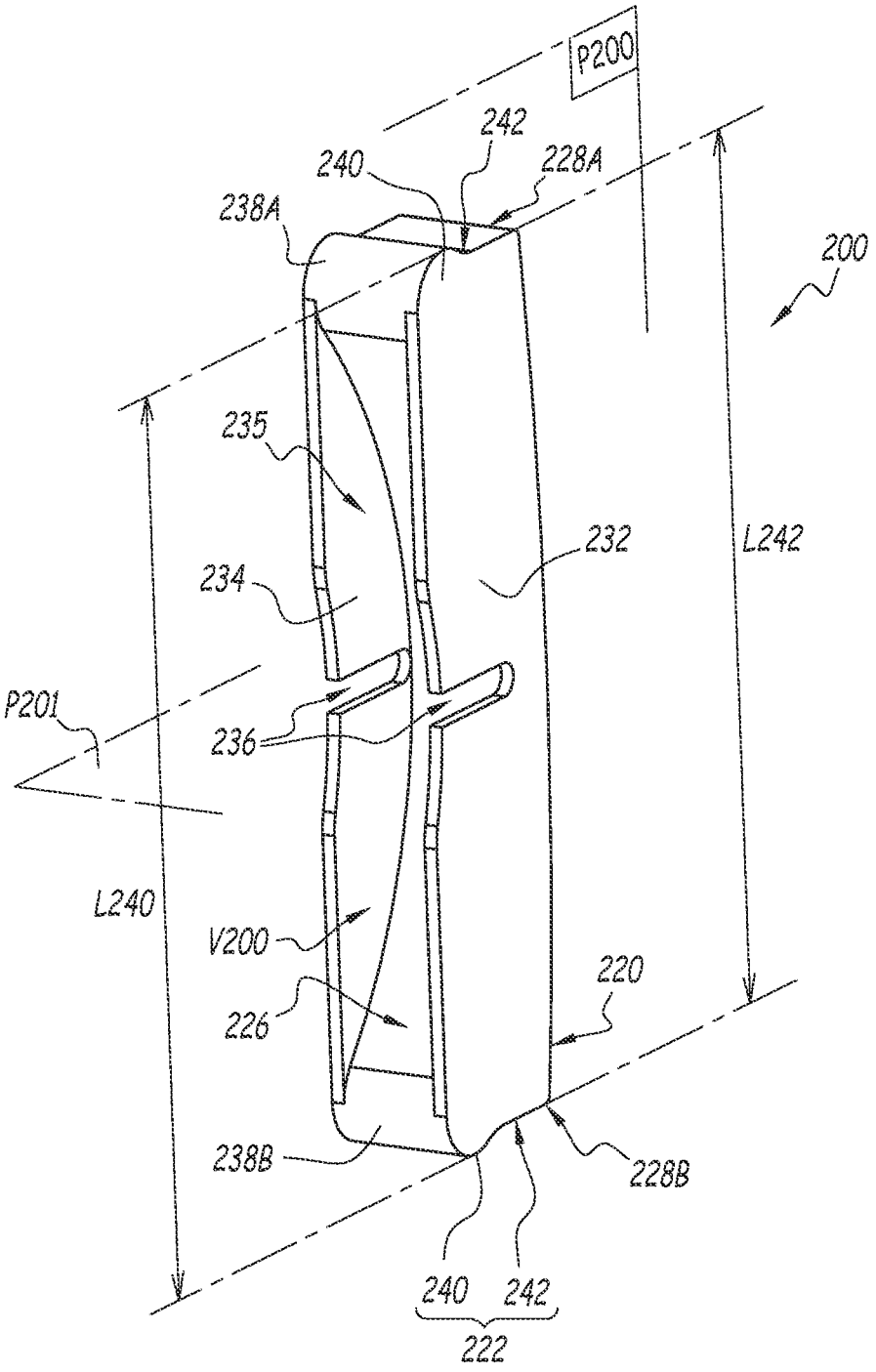
FIG. 7 is a view analogous to FIG. 4, showing a measurement target according to a second embodiment of the invention.
Figure 8:
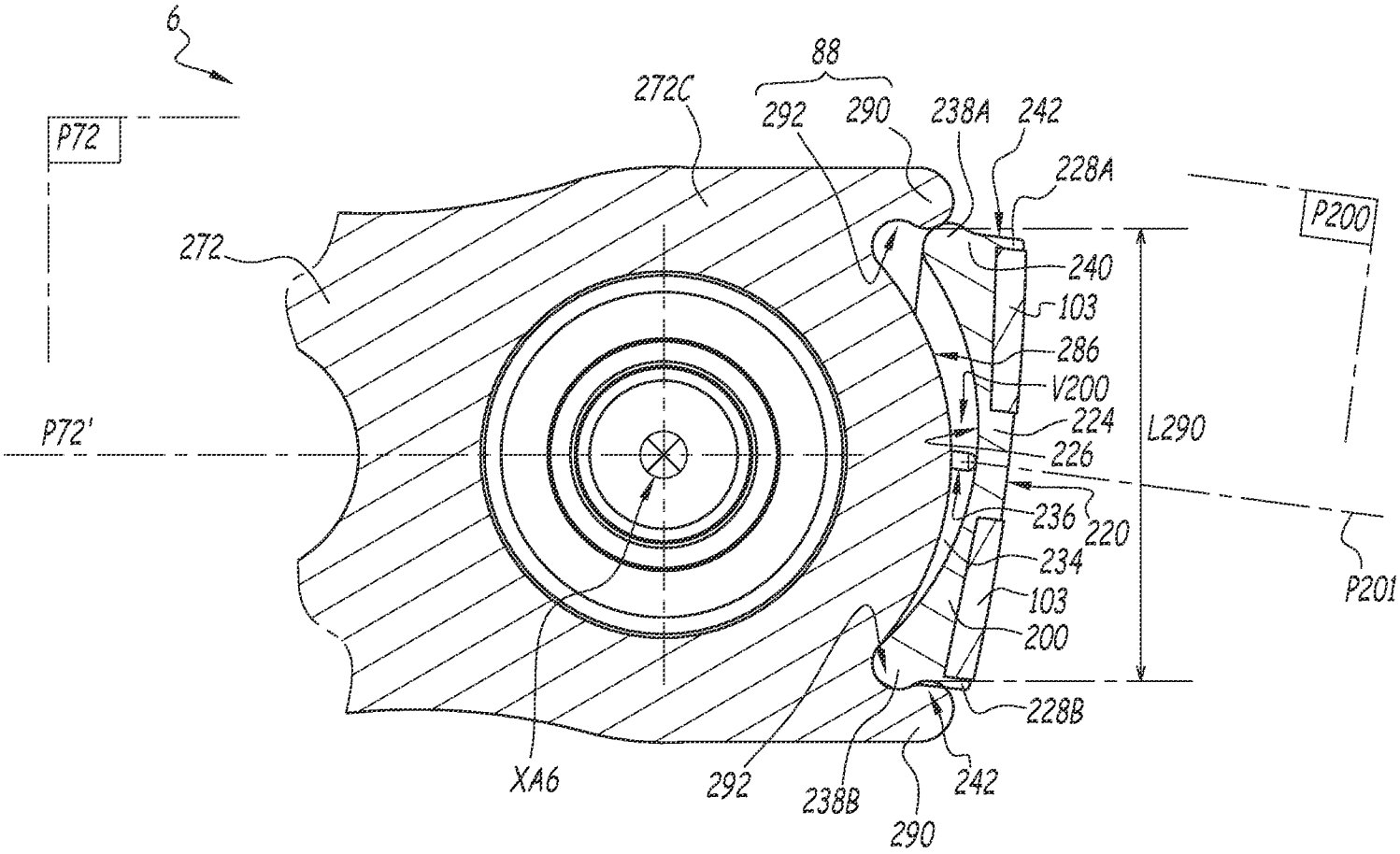
FIG. 8 is a view analogous to FIG. 6, showing the oscillating lever and the measurement target of FIG. 7 in an assembly configuration.

A target 200 according to the second embodiment of the invention is shown in FIGS. 7 and 8. Whereas in the first embodiment of the invention, the complementary connecting means 88 of the measuring portion 72C comprises receiving recesses 92 provided opposite each other while the target recesses 143 are oriented towards each other, the complementary connecting means of the target 200 comprises wall recesses oriented towards each other, while the wall recesses of the measuring portion are oriented opposite each other.

The target 200 is configured to be mounted reversibly to a measuring portion 272C. Here, the measuring portion 272C is provided on a peripheral wall of an oscillating lever 272, said oscillating lever 272 being mounted pivotally in relation to the loom M about a pivot axis orthogonal to the frame plane P4 and not shown.

The target 200 comprises mechanical connection means 222, while the measuring portion 272C includes complementary means 88, which are configured to interact with the connection means 222 so as to secure the target 200 to the measuring portion 272C. In FIG. 8, the target 200 and the measuring portion 272C are shown in an assembly configuration.

The target 200 comprises a flattened, elongated, domed parallelepiped body 224 with a convex outer face 220 configured to face an associated sensor, with an inner face 226 opposite the outer face 220, and with a top end 228A and a bottom end 228B opposite the top end 228A. The sensor, which is not shown, is analogous, preferably identical, to the sensors 110 of the first embodiment.

The outer face 220 is geometrically defined by a cylinder of circular cross section centered on a target axis orthogonal to a longitudinal plane P200 of the target 200. The target axis is not shown. When the target 200 is mounted on the measuring portion 272C of the oscillating lever 272, the target axis is coincident with the pivot axis of the oscillating lever 272.

The inner face 226 has a shape complementary to a receiving area 286 of the measuring portion 272C and is configured to form a means of abutment at the receiving area 286 in a connected configuration of the target 200 on the measuring portion 272C.

The target 200 also comprises two side flanges 232 and 234, each of which extends parallel to the longitudinal plane P200 of the target 200 from a respective edge of the body 224, the two side flanges 232 and 234 being configured to abut the flanks of the measuring portion 272C. The body 224 and the side flanges 232 and 234 define a receiving volume V200 of the receiving wall 286, the receiving volume V200 opening out through an opening 235.

The side flanges 232 and 234 each comprise a radial slot 236, provided radially to the target axis and tangent with the target body 224. In other words, the radial slots 236 extend into the side flanges 232 and 234 to the inner face 226. Here, the radial slots 236 are arranged astride a transverse plane P201 of the target 200. The radial slots 236 arranged such that the target body 224, upon mounting or dismounting the target on the corresponding measuring portion 272C, deforms flexibly by tangential bending in its longitudinal plane P200.

The target 200 comprises two partitions 238A and 238B, which are respectively provided protruding from each of the upper 228A and lower 228B ends of the target body 224. Each of the partitions 238A or 238B comprises an outer bulge 240, at an end away from the inner face 226. The two outer bulges 240 extend away from each other and define a maximum width L240 between them, measured parallel to the longitudinal plane P200.

Each of the bulges 240 abuts a target recess 242, which is provided on the corresponding partition 238A or 238B on the opposite side of the opening 235. The two target recesses 242 are separated by a receiving width L242, measured between the two target recesses 242 parallel to the longitudinal plane P200. The receiving width L242 is smaller in size than the maximum width L240.

The measuring portion 272C comprises two protrusions 290, which extend out from either side of the receiving wall 286 and are directed toward each other. Each protrusion 290 abuts a recess in the wafer 84, which is located between this protrusion 290 and the receiving wall 286 and which forms a receiving recess 292 of a bulge 240. The two protrusions 290 define an interior width L290 between them, measured in the median plane P72. The interior width L290 is less than the maximum width L240 of the bulges 240 of the target 200.

The partitions 238A and 238B and the protrusions 290 are configured so that the partitions 238A and 238B of the target 200, in a connected position of the target 200 on the measuring portion 272C, take position in the receiving recesses 292, while the protrusions 290 take position in the target recesses 242.

In the second embodiment, the mechanical connection means 222 of the target 200 comprise the bulges 240 and the target recesses 242 formed on each of the partitions 238A and 238B, while the complementary means 88 comprise the protrusions 290 sparing the receiving recesses 292, formed on either side of the receiving wall 286.

During assembly, the operator introduces one of the two bulges 240 of one of the two partitions 238A or 238B into a receiving recess 292 of the measuring portion 272C and applies pressure to the other partition 238B or 238A, i.e. to the opposite partition, so as to flex the target body 224 and bring the bulges 240 closer together, so as to insert the uninserted bulge 240 into the corresponding receiving recess 292 and position the target body 224 on the receiving wall 286. In other words, the bending of the body 224 is performed in a reverse direction in relation to the bending of the body 124 of the first embodiment upon mounting the target 100 on the measuring portion 72C. In the configuration of assembling the target 100 on the measuring portion 72C, the partitions 238A, 238B target body 124 are thus brought closer to each other and held together, by a width less than the outer width L290 of the two protrusions 290 before crossing the protrusions 290.

Figure 9:
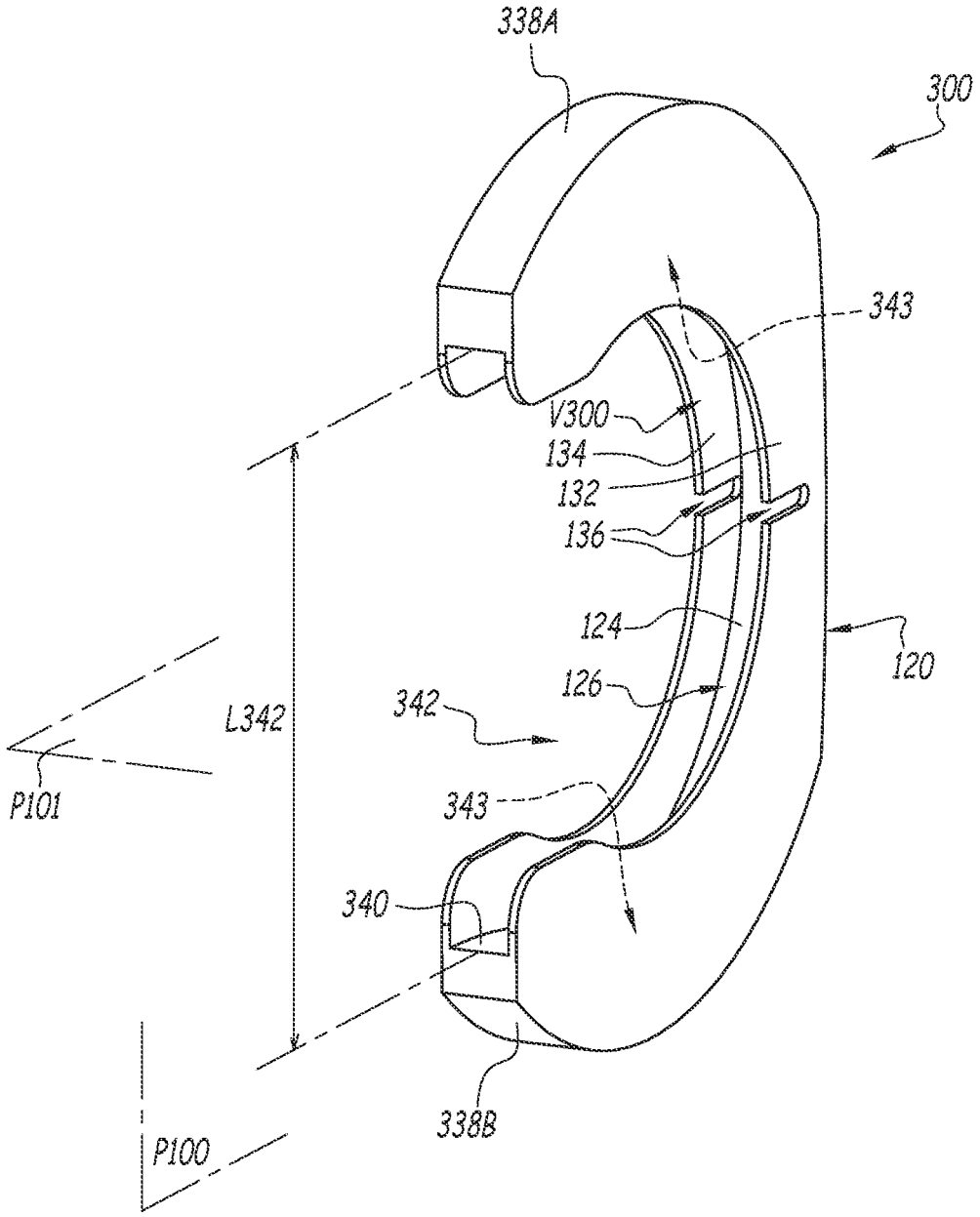
FIG. 9 is a view analogous to FIG. 4, showing a measurement target according to a third embodiment of the invention.
Figure 10:
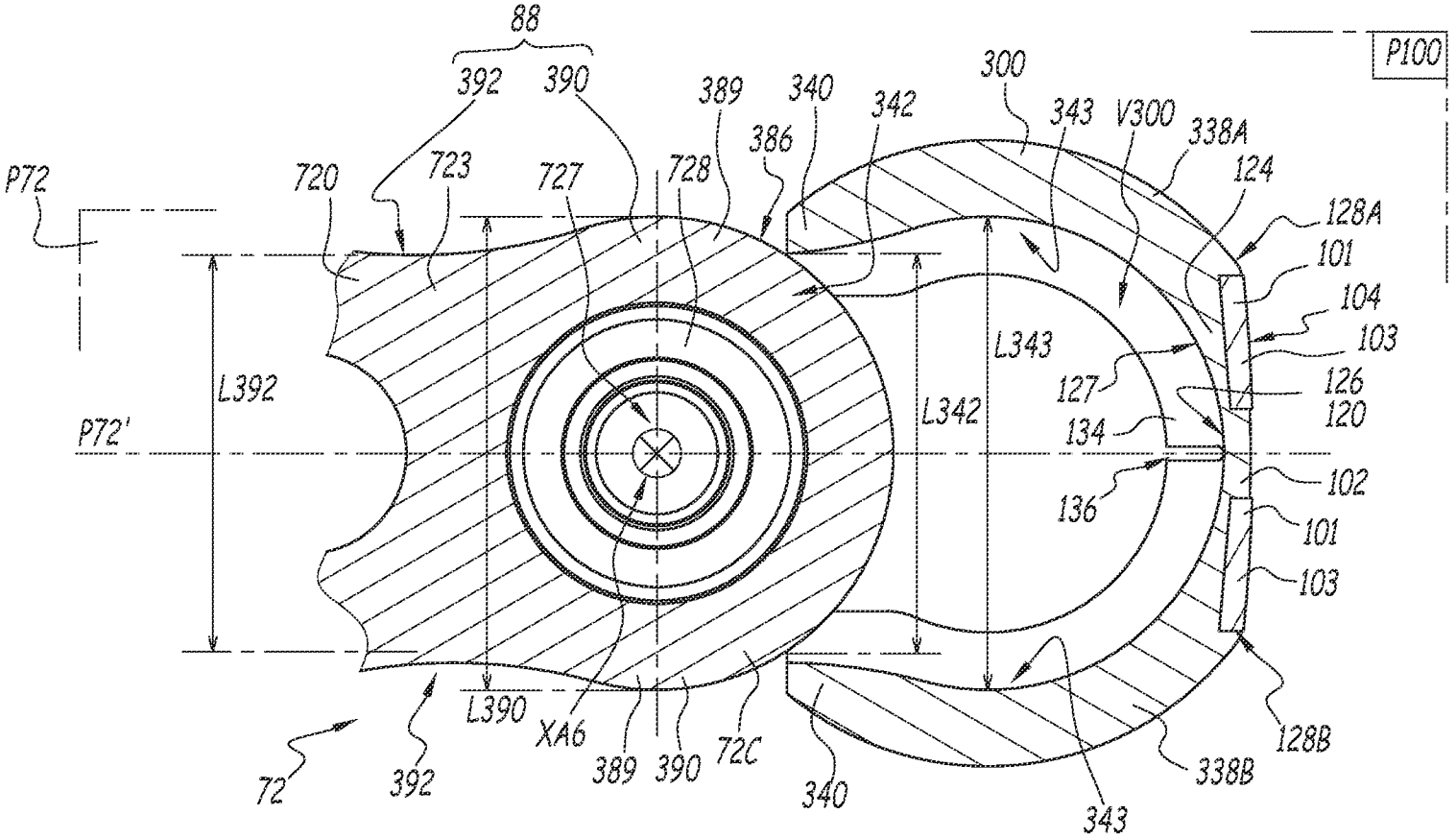
FIG. 10 is a view analogous to FIG. 6, showing the oscillating lever and measurement target of FIG. 9 in an assembly configuration.

A target 300 according to the third embodiment of the invention is shown in FIGS. 9 and 10. In the first and third embodiments of the invention, the complementary means 88 for connecting the measuring portion 72C comprises receiving recesses formed opposite each other, while the target comprises target bulges and recesses facing each other. One of the primary differences of the third embodiment from the first embodiment is that the complementary means 88 comprises bulges 390 and receiving recesses 392 that extend over proportionally larger areas of the measuring portion 72C peripheral to the rotational axis XA6, while the target 300 comprises partitions 338A and 338B that are longer proportionally than the partitions 138A and 1388 of the target 100.

The partitions 338A and 338B and the side flanges 132 and 134 define a receiving volume V300 of the target 300. The receiving volume V300 is configured to receive a receiving area 386 of the measuring portion 72C.

Each of the partitions 338A and 338B comprises an internal bulge 340, at an end away from the inner face 126, that extends into the receiving volume V300. The bulges 340 extend toward each other and define a mouth 342 between them, in the longitudinal plane P100, narrowed in relation to the receiving volume V300. A distance between the two bulges 340, measured parallel to the longitudinal plane P100, defines a mouth width L342.

Each of the bulges 340 abuts a target recess 343, which is provided on the corresponding partition 338A or 338B between the bulge 340 and the bottom 127, on the side of the receiving volume V300. The two target recesses 343 are separated by a receiving width L343, measured parallel to the longitudinal plane P100. The receiving width L343 is of larger dimension than the mouth width L342.

In FIG. 10, the target 300 is shown in an assembled configuration on the measuring portion 72C.

The receiving area 386 has a shape complementary to the bottom 127 of the target 300 and is configured to be received abutting against with the bottom 127 when the target 300 is mounted on the measuring portion 72C. Here, the receiving area 386 has a cylindrical shape of circular cross-section centered on the sixth rotational axis XA6.

The measuring portion wall 72C comprises two lateral portions 389 oriented opposite each other on either side of the receiving wall 386. Each of the two side portions 389 has here a cylindrical shape of circular cross-section centered on the sixth rotational axis XA6. The side portions 389 are configured to be received in the target recesses 343. By extension, the two side portions 389 constitute protrusions 390 of the complementary connecting means 88.

The two protrusions 390 are oriented opposite each other and define an outer width L390 between them, in the median plane P72. Each protrusion 390 abuts a recess formed in the wafer 84, which forms a receiving recess 392 configured to interact with the connecting means 122. In the third embodiment of the invention, the two protrusions 390 are located between the two receiving recesses 392, with the two receiving recesses 392 facing away from each other.

A distance L392 between the bottoms of the two receiving recesses 392, measured in the median plane P72 parallel to the outer width L390, is strictly smaller than the outer width L390 of the two protrusions 390. In other words, the mouth width L342 is smaller than the receiving width L343 of the receiving volume V100 and the outer width L390.

The receiving width L343 is equal to the outer width L390 of the measuring portion 72C, at the near assembly clearances, while the mouth width L342 is equal to the distance L392 between the two receiving recesses 392 at the near assembly clearances.

When mounting the target 300 on the measuring portion 72C, by flexible deformation of the target body 124, and advantageously by the existence of the radial slots 136, the partitions 338A and 338B move apart, to accommodate the passage of the receiving wall 386. The assembly is thus performed by hand and without tools.

The protrusions 390 are advantageously provided in the continuity of the receiving wall 386, i.e. the protrusions 390 and the receiving wall 386 are held by the same circular sectioned cylinder centered on the same axis, here the rotational axis XA6. The manufacturing of the measuring portion 386, which follows a continuous outer profile, is particularly simple to achieve, by cutting, for example, which is inexpensive compared to a machining operation.

Figure 11:
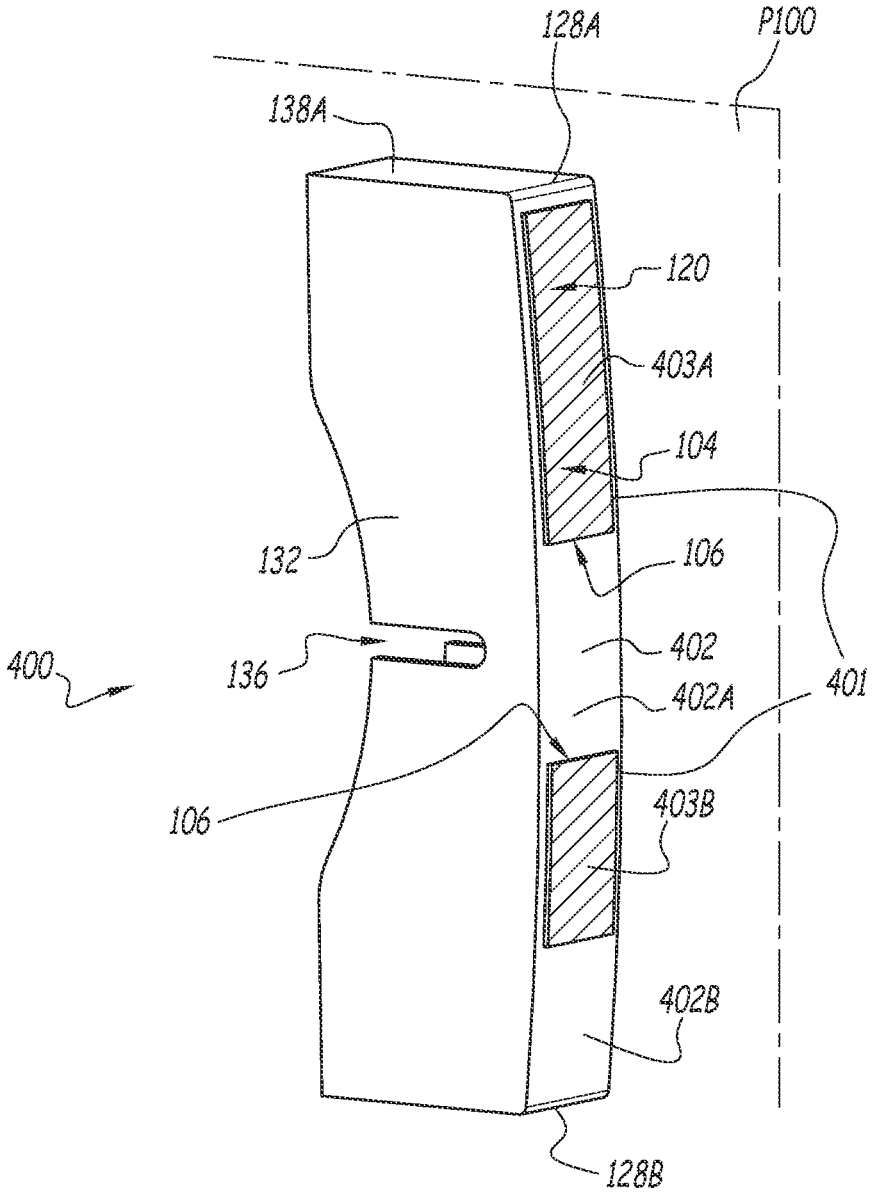
FIG. 11 is a perspective view of a measuring target, shown in isolation and according to a fourth embodiment of the invention.

A target 400 corresponding to the fourth embodiment of the invention is shown alone in FIG. 11. The target 400 has a similar shape to the target 100 of the first embodiment, but differs in that the target 400 comprises two ferromagnetic portions 401 of different lengths, the two ferromagnetic portions 401 being separated by a non-magnetic portion 402.

The ferromagnetic portions 401 here are made by inserts, with an upper insert 403A, located at the top of FIG. 11, and a lower insert 403B. The upper insert 403A here has a length, measured parallel to the longitudinal plane P100, greater than a length of the insert 403B measured parallel to the same plane.

The two ferromagnetic portions 401 are separated by a first non-magnetic portion 402A. The lower insert 403B abuts a second non-magnetic portion 402B, located between the lower insert 403B and the lower end 128B.

Figure 12:
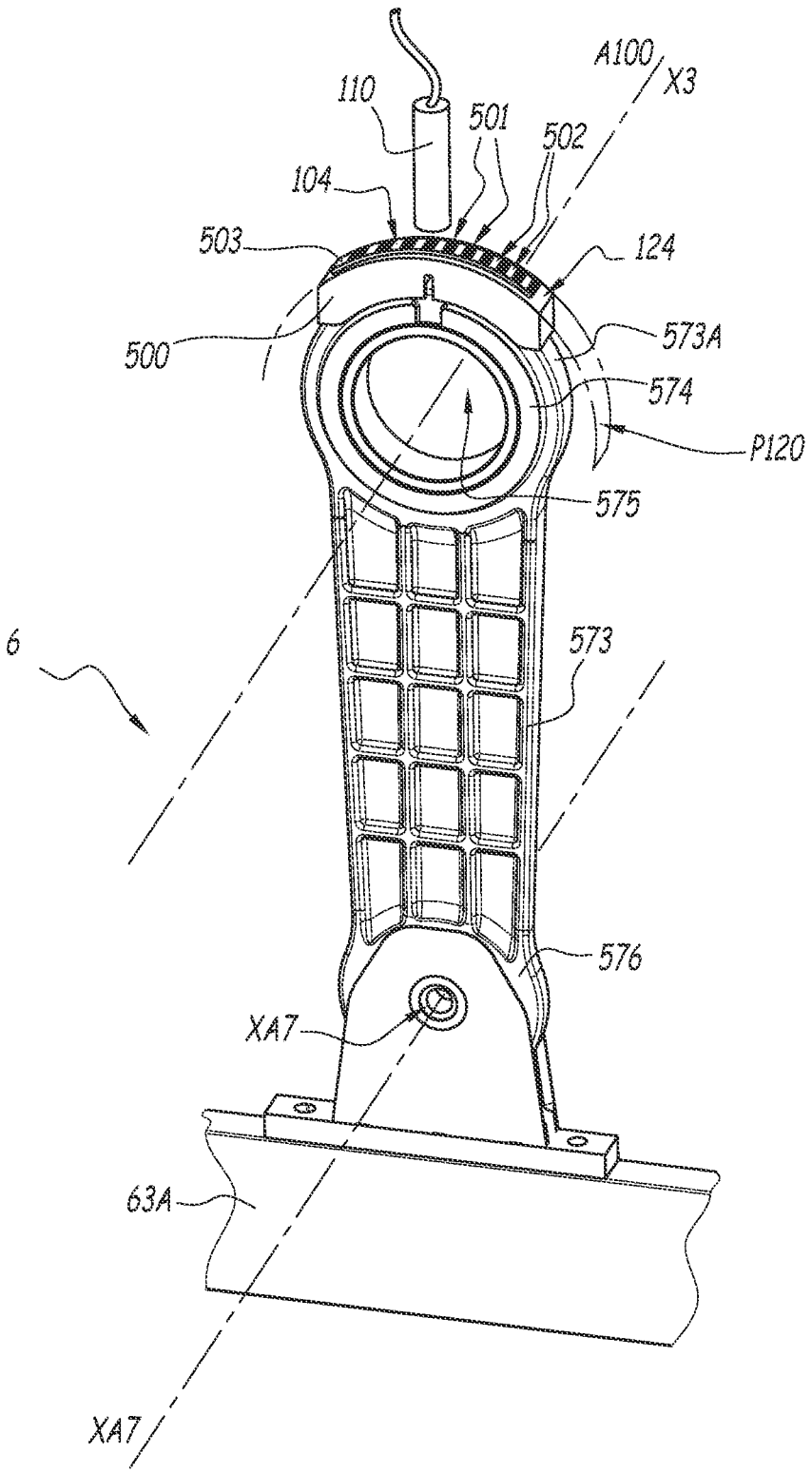
FIG. 12 is a partial perspective view of a variant embodiment of the pulling mechanism of FIG. 1, comprising a stabilizer equipped with a measuring target according to a fifth embodiment of the invention.

The fifth embodiment of the invention is shown in FIG. 12. One of the main differences of the second embodiment from the first embodiment is that the third oscillating lever 73 is replaced by a stabilizer 573. The third actuating rod 66 is omitted. The stabilizer 573 serves to guide the first connecting rod portion 63A during movements of the pulling mechanism 4.

The stabilizer 573 of the pulling mechanism 6 has an elongated shape with a first end 574, in which a bore 575 is formed, and a second opposite end 576. The bore 575 is configured to receive a bearing, such that the stabilizer 573 is pivotally mounted in relation to the loom M about the third pivot axis X3.

At its second end 576, the stabilizer 573 is pivotally mounted in relation to the first connecting rod portion 63A about the seventh rotational axis XA7. In other words, the stabilizer 573 is articulated between the loom M and the first connecting rod portion 63A. In an alternative embodiment not shown, the stabilizer 573 is articulated between the loom M and the second connecting rod portion 63B.

The stabilizer 573 comprises a measuring portion 573A, which here is oriented away from the second end 576 of the stabilizer 573 in relation to the bore 575. A target 500 is reversibly mounted on the measuring portion 573A of the stabilizer 573.

The target 500 resembles the target 100 of the first embodiment of the invention in relation to the connecting means 122 of the target 100 and the complementary means 88 of the measuring portion 72C. In contrast, the target 500 does not comprise ferromagnetic inserts, but here comprises an insert 503, which is attached directly to the body 124 of the measurement target 500 and in which ferromagnetic portions 501 and non-magnetic portions 502 are provided. The insert 503 is here made by means of a flexible tongue, which is glued to the target body 124.

The ferromagnetic portions 501 are shown schematically as black stripes, while the non-magnetic portions 502 are shown as white stripes. Two successive ferromagnetic portions 501 are separated by a non-magnetic portion 502, so that when the stabilizer 573 pivots about the third pivot axis X3, an alternation of ferromagnetic portions 501 and non-magnetic portions 502 passes in front of the sensor 110 located facing the target 110.

In a variant not shown, the pulling mechanism 6 comprises several sensors 110 capable of interacting with the same target 100 at various angular positions.

In a variant not shown, the measurement target 100 comprises a ferromagnetic insert. The target then makes it possible to know the position of the measuring portion by means of one sensor or by means of several sensors.

In the illustrated embodiments, each of the targets 100 to 500 has a generally symmetrical shape in relation to the transverse plane P101. In other words, the connecting means 122 or 222 have a symmetrical shape in relation to the transverse plane P101, while the complementary means 88 also have a symmetrical shape in relation to a radial plane P72' of the measuring portion 72C, the radial plane P72' being coincident with the transverse plane P101 when the target is mounted on the corresponding measuring portion. The target can thus be mounted on the measuring portion in two different directions in relation to the transverse plane P101.

In a variant, the ferromagnetic portions 501 may be replaced by magnetic portions such as individual magnets generating a magnetic field that can be sensed by an associated sensor, facing the individual magnet.

In a variant, not shown, the connecting means and the complementary means are asymmetrical, in relation to the transverse plane P101 of the target and the radial plane P72' respectively. The target can thus be mounted on the measuring portion only in one direction in relation to the radial plane P72'. In other words, the connecting means 122 and the complementary means 88 are configured to assemble the target on the receiving wall in an oriented manner in relation to the radial plane P72'.

In a variant, not shown, the side flanges may be formed of a plurality of radial protrusions extended from a respective edge of the body to abut the flanks of the measuring portion, and separated from each other such that they allow flexing of the target body, substituting the radial slots of the side flanges.

The asymmetrical connecting means and complementary means are recommended when the ferromagnetic and non-magnetic portions are not arranged symmetrically in relation to the transverse plane P101, as in the case of the target 400 of the fourth embodiment of the invention.

In the illustrated embodiments, the complementary connecting means 88 are provided on the wafer 84 of the measuring portion 72C, while the connecting means 122 or 222 extend parallel to the longitudinal plane P100.

In a variant, not shown, the connecting means are provided orthogonally to the longitudinal plane P100, while the complementary means are provided on the sides of the measuring portion 72C. For example, the mechanical connection means of the target comprise lugs, which are provided protruding from the lateral flanges and extend on the side of the target receiving volume, while complementary recesses are provided in the first and second flanks of the measuring portion. During mounting, the lugs of the side flanges move away from each other in relation to the plane P72' by flexible deformation. When the target is mounted on the measuring portion, the lugs are held in the housings by the flexible return of the side flanges.

In other words, the target comprises mechanical connection means arranged in the extension of the two lateral flanges, these connection means being spaced apart by a distance less than the thickness of the wafer 84 or equivalent, while the receiving wall comprises the complementary connection means that comprise recesses arranged in the first and second flanks of the measuring portion, In the illustrated examples, the first oscillating lever 71 and the second oscillating lever 72 are connected to each other via the connecting rod 62, which is made in two articulated parts, by means of the first and second connecting rod portions 63A and 63B which are guided either by means of the third oscillating lever 73 or by means of the stabilizer 573.

In a variant, not shown, the connecting rod 62 is not articulated and directly connects the first oscillating lever 71 to the second oscillating lever 72. In this case, the third oscillating lever 73 or the stabilizer 573 are optional.

In the illustrated example, the shedding machine 2 is of the mechanical cam type, with each output rod 61 articulated to an exit arm 22 of the shedding machine 2.

In an alternative embodiment not shown, the shedding machine is of the mechanical dobby type, with each output rod 61 articulated to an exit arm of the mechanical dobby.

According to another variant not shown, the shedding machine is of the electronic dobby type, which comprises independent electric actuators such as motors, with oscillating rotary motion, each connected to a crank. Each output rod 61 is then articulated to a respective crank. In other words, a crank is articulated between the electric actuator and a corresponding output rod.

The above-mentioned embodiments and variants may be combined with each other to generate new embodiments of the invention.

The invention claimed is:

1. A pulling mechanism for controlling the heald frames of a loom equipped with a shedding machine, the pulling mechanism comprising, for each heald frame:

a set of connecting rods, oscillating levers, coupled to the rod assembly and configured to return a movement of an exit arm or crank of the shedding machine to the heald frame so as to drive this heald frame in a alternating motion along a frame axis between an up and a down position, wherein the oscillating levers are associated with the heald frame and comprise a first oscillating lever and a second oscillating lever, of which:

the first oscillating lever is pivotally mounted in relation to the loom about a first pivot axis, orthogonal to a frame plane, the second oscillating lever is pivotally mounted in relation to the loom about a second pivot axis, parallel to the first pivot axis, wherein the rod assembly comprises:

a primary connecting rod, configured to be connected to the exit arm or crank about a first joint, which makes a pivotal connection about an rotational axis parallel to the first pivot axis, a first actuating rod, configured to be connected to a first end of the heald frame and intended to drive the heald frame in movement along the frame axis, a second actuating rod, configured to be connected to a second end of the heald frame and intended to drive the heald frame in movement along the frame axis, at least one connecting rod, which connects the first oscillating lever to the second oscillating lever and is intended to drive the second oscillating lever, wherein the first oscillating lever:

is connected to the primary connecting rod about a second joint that makes a pivot connection about an rotational axis parallel to the first pivot axis, is intended to drive the first actuating rod via a third joint and to drive the connecting rod via a fourth joint, the third joint and the fourth joint each making a pivotal connection about a respective rotational axis parallel to the first pivotal axis, wherein the second oscillating lever:

is articulated to the connecting rod about a fifth joint, is intended to drive the second actuating rod via a sixth joint, the fifth joint and the sixth joint each making a pivotal connection about a respective rotational axis parallel to the first pivotal axis, wherein the pulling mechanism comprises at least one measuring portion, equipped with a target, the target being configured to interact with a sensor, wherein each measuring portion is provided on a peripheral wall of one of the elements selected from:

the first oscillating lever, the second oscillating lever, a third oscillating lever or a stabilizer of the pulling mechanism, the third oscillating lever or the stabilizer each being mounted so as to pivot in relation to the loom about a third pivot axis parallel to the first pivot axis and being articulated to the connecting rod, and wherein the target is reversibly mounted on the measuring portion.

2. The pulling mechanism according to claim 1, wherein the measuring portion comprises:

a first flank and a second flank opposite the first flank, which define a median plane between them, orthogonal to the first pivot axis, an edge, which connects the first side to the second side with a constant thickness, and wherein the edge defines a receiving area, which is configured to receive the target radially to the pivot axis of the corresponding element.

3. The pulling mechanism according to claim 2, wherein the receiving area has a generally convex shape in the median plane, with the measuring portion arranged:

on one end of an arm of the first oscillating lever or an arm of the second oscillating lever or an arm of the third oscillating lever, or about the first pivot axis of the first oscillating lever or the second pivot axis of the second oscillating lever or the third pivot axis of the third oscillating lever, or even on one end of the stabilizer.

4. The pulling mechanism according to claim 2, wherein the target comprises:

a target body, which extends between a first end and a second end and between two parallel edges located on either side of a longitudinal plane coinciding with the median plane when the target is mounted on the measuring portion, which comprises an inner face, configured to be mounted opposite and to interact with the receiving area, and an outer face, opposite the internal face and oriented towards the sensor, the outer face being geometrically defined by a cylinder of circular cross-section and centered on a target axis, which is coincident with that of the axes among the first two lateral flanges, which each extend parallel to the longitudinal plane from a respective edge of the body, and which are configured to bear on the first and second flanks, wherein the body and the lateral flanges delimit a receiving volume of the receiving area, the receiving volume opening out through an opening centered on the longitudinal plane and having a width substantially equal to the thickness of the wafer, measured orthogonally to the longitudinal plane, and wherein the target is provided with mechanical connecting means:

which interact with the measuring portion so as to set the target to this measuring portion, and which are arranged at each first end or second end of the body and/or in the extension of the lateral flanges.

5. The pulling mechanism according to claim 4, wherein:

the target body is made of synthetic polymeric material, the side flanges each comprise:

a lateral face extended parallel to the longitudinal plane, and a radial slot, provided on the lateral face as far as the internal face, the radial slots being arranged so that the target body is flexibly deformed by tangential bending in its longitudinal plane, when the target is mounted or dismounted on the measuring portion, so as to move the mechanical connection means away from or towards each other.

6. The pulling mechanism according to claim 4, wherein the receiving area comprises complementary means for connecting to the mechanical connecting means of the target, the complementary connecting means being configured to interact with the connecting means, so as to set the target on the measuring portion.

7. The pulling mechanism according to claim 4, wherein the target comprises mechanical connection means arranged in the extension of the two lateral flanges, spaced apart by a distance less than the thickness of the wafer, while the measuring portion comprises the complementary connecting means, which comprise recesses arranged in the first and second flanks of the measuring portion and configured to interact with the connecting means, so as to set the target on the measuring portion.

8. The pulling mechanism according to claim 4, wherein the inner face of the target body has a shape complementary to the receiving area and forms abutment means to the receiving wall.

9. The pulling mechanism according to claim 8, wherein:

the mechanical connecting means comprise two partitions, which extend from each of the first end and second end of the target body toward the opening, and two target recesses, each adjoining a partition on the side of the opening, each of the partitions comprises an internal bulge on the side of the opening, the internal bulges extending towards each other and defining a mouth between them, in the longitudinal plane, having a mouth width, measured parallel to the longitudinal plane, less than a receiving width measured between the two target recesses, the complementary connecting means comprise:

two radially projecting protrusions, which are directed away from each other and which define an outer width between them greater than the mouth width, in the median plane, and two recesses, formed in the edge, each adjoining a protrusion and each forming a receiving recess for the bulge of a respective partition, wherein the partitions and the radially projecting protrusions are configured such that each of the bulges, in an assembled configuration of the target on the measuring portion, takes position in one of the receiving recesses, while each of the protrusions takes position in one of the target recesses, and wherein the target is configured to be disassembled from the measuring portion by reversible, flexible deformation of the target body.

10. The pulling mechanism according to claim 8, wherein the mechanical connecting means comprises:

two partitions provided in projection at each of the lower and upper ends of the target body, and two target recesses each adjoining a partition opposite the opening, each of the partitions comprising an outer bulge, at an end away from the inner face, the two outer bulges extending opposite each other and defining between them, in the longitudinal plane:

a maximum width measured parallel to the longitudinal plane, and a receiving width measured between the two target recesses that is smaller than the maximum width, the complementary connecting means comprise:

two radially projecting protrusions, which are directed towards each other and which define an outer width, in the median plane, smaller than the maximum width of the target partitions, two recesses, arranged in the edge, each adjoining a protrusion and each forming a receiving recess, wherein the projecting partitions and protrusions are configured such that, in an assembled configuration of the target on the measuring portion, each partition takes position in one of the receiving recesses, while the protrusions take position in the target recesses, and wherein the target is configured to be disassembled from the measuring portion by reversible flexible deformation of the target body.

11. The pulling mechanism according to claim 9, wherein the radially protruding protrusions) and the wall recesses each have a profile with respective radii of curvature greater than 2 mm, preferably greater than 5 mm.

12. The pulling mechanism according to claim 4, wherein the outer face of each target comprises at least one ferromagnetic portion and at least one non-magnetic portion, each ferromagnetic portion adjoining a non-magnetic portion of the target.

13. The pulling mechanism according to claim 12, wherein the target comprises two ferromagnetic portions of equal length, which are separated by a non-magnetic portion.

14. The pulling mechanism according to claim 12, wherein the target comprises two ferromagnetic portions of different lengths, which are separated by a non-magnetic portion.

15. The pulling mechanism according to claim 14, wherein the receiving area comprises complementary means for connecting to the mechanical connecting means of the target, the complementary connecting means being configured to interact with the connecting means, so as to set the target on the measuring portion, wherein the connecting means of the target and the complementary connecting means of the measuring portion:

are asymmetrical in relation to a transverse plane of the target, the transverse plane being radial to the target axis and determining an upper and a lower target portion of similar volumes, and are configured to assemble the target to the receiving wall of the measuring portion in an oriented manner.

16. The pulling mechanism according to claim 12, wherein:

the ferromagnetic portions of each target comprise inserts made of a ferromagnetic material such as metal, while the target body is made of a non-magnetic material, each insert comprises an outer face, which is geometrically held by the cylinder defining the outer face of this target, the measuring portion is contained in the cylinder defining the outer face of this target.

17. The pulling mechanism according to claim 16, wherein the outer face of at least one insert is defined in the longitudinal plane of the target, between two edges that are sharp and parallel to the target axis.

18. The pulling mechanism according to claim 1, wherein each sensor is fixedly mounted in relation to a frame of the loom facing the target that equips the measuring portion.

19. The pulling mechanism according to claim 18, wherein the outer face of each target comprises at least one ferromagnetic portion and at least one non-magnetic portion, each ferromagnetic portion adjoining a non-magnetic portion of the target, wherein the ferromagnetic portion or portions and the non-magnetic portion or portions of the same target together form a detection area, which extends along an angular sector greater than an angular stroke of this target when the measuring portion, on which this target is mounted, pivots between its high position and the low position.

20. A loom equipped with a shedding machine, wherein the shedding machine comprises a pulling mechanism according to claim 1.

* * * * *